US011976377B2

(12) United States Patent
Tran et al.

(10) Patent No.: US 11,976,377 B2
(45) Date of Patent: May 7, 2024

(54) METHOD TO COAT METALS ONTO SURFACES

(71) Applicant: Earth Science Laboratories, Inc., Rogers, AR (US)

(72) Inventors: Nam Tran, Crystal, MN (US); John A. Hatten, Jr., Rogers, AR (US); Reid Henry Bowman, Kihei, HI (US); Jeffrey Alan Keiser, Rogers, AR (US); David Hammond, Greenbrae, CA (US); Freddie L. Singleton, Fruit Cove, FL (US); David Nicholas, Gulf Breeze, FL (US)

(73) Assignee: EARTH SCIENCE LABORATORIES, INC., Rogers, AR (US)

( * ) Notice: Subject to any disclaimer, the term of this patent is extended or adjusted under 35 U.S.C. 154(b) by 0 days.

(21) Appl. No.: 18/081,648

(22) Filed: Dec. 14, 2022

(65) Prior Publication Data

US 2023/0257895 A1 Aug. 17, 2023

Related U.S. Application Data

(60) Provisional application No. 63/265,397, filed on Dec. 14, 2021.

(51) Int. Cl.

| | |
|---|---|
| ***C25D 3/02*** | (2006.01) |
| ***C25D 5/02*** | (2006.01) |
| ***C25D 5/10*** | (2006.01) |

(52) U.S. Cl.

CPC ..... *C25D 3/02* (2013.01); *C25D 5/02* (2013.01); *C25D 5/10* (2013.01)

(58) Field of Classification Search

None

See application file for complete search history.

(56) References Cited

U.S. PATENT DOCUMENTS

| | | | | |
|---|---|---|---|---|
| 3,684,666 | A | 8/1972 | Shaw et al. | |
| 4,011,276 | A | 3/1977 | Chu | |
| 4,104,139 | A * | 8/1978 | Cargnino | C07F 9/098 987/226 |
| 4,135,012 | A | 1/1979 | Su | |
| 5,738,914 | A | 4/1998 | Macmillan | |
| 9,938,171 | B2 | 4/2018 | Nicholas et al. | |

(Continued)

FOREIGN PATENT DOCUMENTS

WO 2021174203 A1 9/2021

OTHER PUBLICATIONS

English translation KR 20060049441 (Year: 2006).*

(Continued)

*Primary Examiner* — Stefanie S Wittenberg

(74) *Attorney, Agent, or Firm* — Kilpatrick Townsend & Stockton LLP

(57) ABSTRACT

Described herein are methods of applying metals to substrates, where the methods include contacting the substrate with an aqueous metal plating composition comprising polyammonium bisulfate ("PABS") and a dissolved metal or salt thereof. The methods allow application of metals to the substrate without need for electrical energy input or for an added chemical catalyst, chelating agent, complexing agent, reducing agent, stabilizer, or pH-modifying (or controlling) chemical compound.

27 Claims, 16 Drawing Sheets

(56) References Cited

U.S. PATENT DOCUMENTS

| | | | |
|---|---|---|---|
| 10,544,055 | B2 | 1/2020 | Nicholas et al. |
| 10,807,889 | B2 | 10/2020 | Nicholas et al. |
| 2016/0366877 | A1 | 12/2016 | Nicholas et al. |

OTHER PUBLICATIONS

English translation of DE102016110377 (Year: 2017).*
English translation JP2006-339287 (Year: 2006).*
PCT/US2022/052904 , "International Search Report and Written Opinion", dated Mar. 7, 2023, 8 pages.

* cited by examiner

Zinc Sulfate Copper "Thin" Copper "Thick" 304 Stainless Steel

Zinc Sulfate (a)

Copper "Thin" (b)

Copper "Thick" (c)

7372 Date:6/5/2009 1:04:45 AMIage size:512 x 384Mag:100000xHV:15.0kV

METHOD TO COAT METALS ONTO SURFACES

CROSS-REFERENCE TO RELATED APPLICATIONS

The present application claims the benefit of U.S. Provisional Patent Application 63/265,397, filed Dec. 14, 2021, the entirety of which is hereby incorporated by reference.

FIELD

This disclosure provides the use of an aqueous metal plating solution comprising polyammonium bisulfate, optionally an acid, optionally other additives, and water with at least one dissolved metal or metal salt to apply a metallic layer to the surface of an object or material.

BACKGROUND

The patent, trade, and peer-reviewed scientific literature contains details of a wide variety of metal deposition techniques and processes to apply a layer or coating of a metal onto an object or material. Each metal deposition technique has specific advantages and disadvantages. Depending on the anticipated use of an object or material that receives a metal coating, more than one process or application technology may be used. Such hybrid techniques are being developed and employed in industrial applications. To date, there is no specific, widely accepted method to classify all metal deposition techniques or metal deposition processes.

The ability to selectively coat an object or material with a metal has been known and practiced in many ways for centuries. Modern industrial metal plating processes are used to cover an object or material fully or partially with one or more metals.

Although several diverse types of metal plating or metal deposition technologies have been developed, they all share the common goal of selectively applying a metal coating or metal layer onto an object or material. Examples of metal plating of objects and materials range from pipes and tubing to industrial valves and fittings to electronic components to, among others, personal jewelry, medical instruments, and some household items. Regardless of the specific metal plating method or process used, the goal is to apply a layer of a selected metal to the exterior or interior surfaces to impart at least one desired characteristic to the object or material being coated. For example, depending on the metal being applied to an object or material, there can be improved resistance to corrosion, more efficient heat transfer, reduced friction, or improved electrical conductivity, among others such as wear resistance, reflectivity, and appearance (e.g., brightness or color), torque tolerance, solderability, and tarnish resistance. A common metal plating method or process is referred to as electroplating. During this process, an electric current is used to mobilize metal ions from an anode or an electrolyte solution containing a soluble metal or metal salt to an object or material that serves as the cathode. Electroplating is widely used in industry as a means of applying metal coatings to a wide range of products. The end-use of an object or material will determine the specifications for an electrolytic process. For example, electrolytic plating processes may be optimized by controlling the concentration of metal ions in the plating bath. Other parameters such as pH, current density, and temperature can affect the plating process.

Another process for coating metals onto surfaces of objects is referred to as electroless plating, a method of metal deposition without the use of an electric current. Electroless process solutions vary in composition, depending on the plating objective, but the solutions typically include a solvent, a source of ions of the metal to be deposited, a reducing chemical, e.g., formaldehyde, that generate ions of the metal to be deposited, a complexing agent for the ions of the metal to be deposited, and a chemical agent that regulates pH within a desired range (e.g., acidic plating solutions are in a pH range of about 3.8 to 4.2). Compared to electrolytic plating, electroless processes are much slower and more expensive to operate. See U.S. Pat. No. 3,684,666 and Jeevarani (2014) Study on developing nano coated solar photovoltaic cell and optimizing its process parameters to improve the energy absorbing efficiency. Doctoral Dissertation, Pondicherry University, India.

Yet another plating process that involves use of a solution containing metal ions is immersion plating. This process involves immersing a metallic object or material composed of a non-noble metal into a solution of containing ions of another metal, primarily a noble metal. Immersion plating is a slow process and can only be used for plating non-noble or less noble metals with more noble metals.

Although electroplating, electroless plating, and immersion plating are widely practiced on industrial scales, these processes require significant infrastructure, many steps (e.g., cleaning, rinsing, etc.), and can be energy and/or raw material intensive. Indeed, some processes include use of toxic or harmful chemicals, e.g., formaldehyde, concentrated acids, and caustics, etc. In some cases, such chemicals are used to prepare surfaces before a metal coating is applied. See, for example, U.S. Pat. No. 4,135,012, the teachings of which are incorporated herein by reference. Other metal plating or deposition processes have been developed for special applications or purposes. For example, chemical vapor deposition.

The degree of success of applying a metallic layer onto an object or material depends on the method used, process conditions, physico-chemical characteristics of the object or material, and redox potential values for the individual metals. See, for examples of redox potential values, Vanysek, P., 2000. Electrochemical series. CRC handbook of chemistry and physics, 8. Pp. 8.20-8.29.), the teachings of which are incorporated herein by reference as are references cited therein.

SUMMARY

Disclosed herein are methods of applying a metal coating of a desired thickness and composition via modification of crystallinity of said metal layer on the surface of an object or material. A key aspect of the present invention is the use of an aqueous solution of polyammonium bisulfate ("PABS"), which is defined herein.

As described herein, an aqueous solution of PABS, and optionally, other water-soluble components, for example, an acid, and a metal or salt thereof can be prepared and used to apply a metal coating to an object or material. Unless otherwise specified, percentages are expressed on a "weight basis" (also designated as "w/w") wherein the weight of the metal-containing solution is divided by the weight of the total solution.

As described herein, a metal coating can be applied by wetting all or a specific area of a surface of an object or material with an aqueous solution comprised of a metal salt, or a combination of metal salts, in an aqueous formulation of water, PABS, and preferably, sulfuric acid, wherein the concentration of the PABS in the formulation is from about 0.01 mg/L to about 400,000 mg/L.

The present disclosure also relates to a method for using a PABS solution containing a specific metal in a concentration range of about 0.001% (w/w) to about 25% (w/w) or more, depending on the solubility of the metal used, to form a metal coating to the surface or specific area on the surface of a metallic object or material. This surprising and unexpected result occurs in the absence of an electrical current, a reducing agent, a catalyst, a stabilizer, or a pH-controlling buffer. In addition, deposition of some metals onto the surface or selected areas of a surface occurs at room temperatures, e.g., 20-25° C. For some metals, deposition onto a surface requires a higher activation energy which is overcome with increased temperature. As detailed in the examples herein, some metals that require higher reaction process temperatures include ruthenium and tungsten. Furthermore, process temperature can be used as a means of controlling the deposition rate of a metal onto an object or material.

The present disclosure also relates to selective placement of a metal-containing aqueous PABS solution onto a predetermined surface on or in an object or material so that a layer of the dissolved metal is formed with a desired shape, quality, and thickness. The predetermined area for coating with a metal can be the total surface area of an object or material or a portion thereof selected or within the boundaries of the selected area in a specific pattern.

As described herein, an embodiment of this invention is a method for coating the surface or a defined area of an object or material with a selected metal, or combination of metals, can be accomplished when said metal or metals is/are dissolved in a PABS-containing aqueous solution and applied to a specific area, including the totality of the surface area, of an object or material, for a specific time interval to obtain a coating of a desired thickness.

The present disclosure also relates to the use of PABS solutions prepared without added metal or metal salt to prepare a surface to be covered with a metal coating comprising one metal or a combination of metals.

The present disclosure relates to a method to use metal-containing PABS solutions to coat a metallic object or material with a metal layer or multiple layers of metals, depending on the desired characteristics of the coated object or material.

The disclosure also provides methods for contacting the surface to be treated with a metal-containing PABS solution wherein the PABS-metal solution is applied by a method selected from the group comprising immersion, spraying, applying a foam or gel, and micro-droplet deposition on selected locations or in a linear or otherwise specific pattern within a specified area of a surface, or an automated or manual brush or another mechanical device.

The disclosure also provides methods for contacting the surface to be treated with a metal-containing PABS solution wherein the PABS-metal solution is repeatedly applied by a method selected from the group comprising immersion, spraying, micro-droplet deposition, applying a foam or gel on selected locations or in a linear or other pattern within a specified area of a surface, or an automated or manual brush or other mechanical device such that multiple layers of a specific metal accumulate to a specific thickness.

The disclosure further provides methods for contacting the surface to be treated with metal-containing PABS solutions simultaneously or sequentially wherein the PABS-metal solutions are applied by a method selected from the group comprising applying a foam or gel, immersion, spraying, and micro-droplet deposition on selected locations or in a linear or other defined pattern within a specified area of a surface, or an automated or manual brush or other mechanical device such that layers of one or more metals can be applied in close proximity in predetermined patterns or shapes.

An embodiment of the disclosure described herein is a method of applying a metal-containing PABS solutions by a method selected from the group comprising immersion, spraying, applying a foam or gel, and micro-droplet deposition on selected locations or in a linear or other defined pattern within a specified area of a surface, or an automated or manual brush or other mechanical device such that layers of one or more metals can be applied in close proximity in predetermined patterns or shapes and said applied metal pattern is a straight or curved line whereby the metal is used to conduct electricity. Likewise, an embodiment is to apply a PABS-metal composition which, after plating the dissolved metal onto the substratum, provides an electrically-conductive path on or in an object or material. It is anticipated that the preferred width of an electrically-conductive metal path would be in a range of about $1\times10^{-10}$ m to about $1\times10^{-2}$ m, preferably in the range of about $2.5\times10^{-10}$ m to about $1\times10^{-3}$ m.

BRIEF DESCRIPTION OF THE DRAWINGS

Features and advantages of the methods of the present invention will be more fully appreciated by reference to the following detailed description of presently preferred but nonetheless illustrative embodiments in accordance with the present invention.

FIG. 5A shows the impact ball test results for zinc sulfate standard steel coupons. FIG. 5B shows the impact ball test results for "thin" copper plated steel coupons. FIG. 5C shows the impact ball test results for "thick" copper plated steel coupons.

FIG. 16A is a chart showing thicknesses of Pd layers measured using X-ray fluorescence after submersion in a palladium-containing plating bath for 5, 10, and 20 minutes. FIG. 16B illustrates examples of Pd coated onto nickel metal coupons.

DETAILED DESCRIPTION

Figure 1:
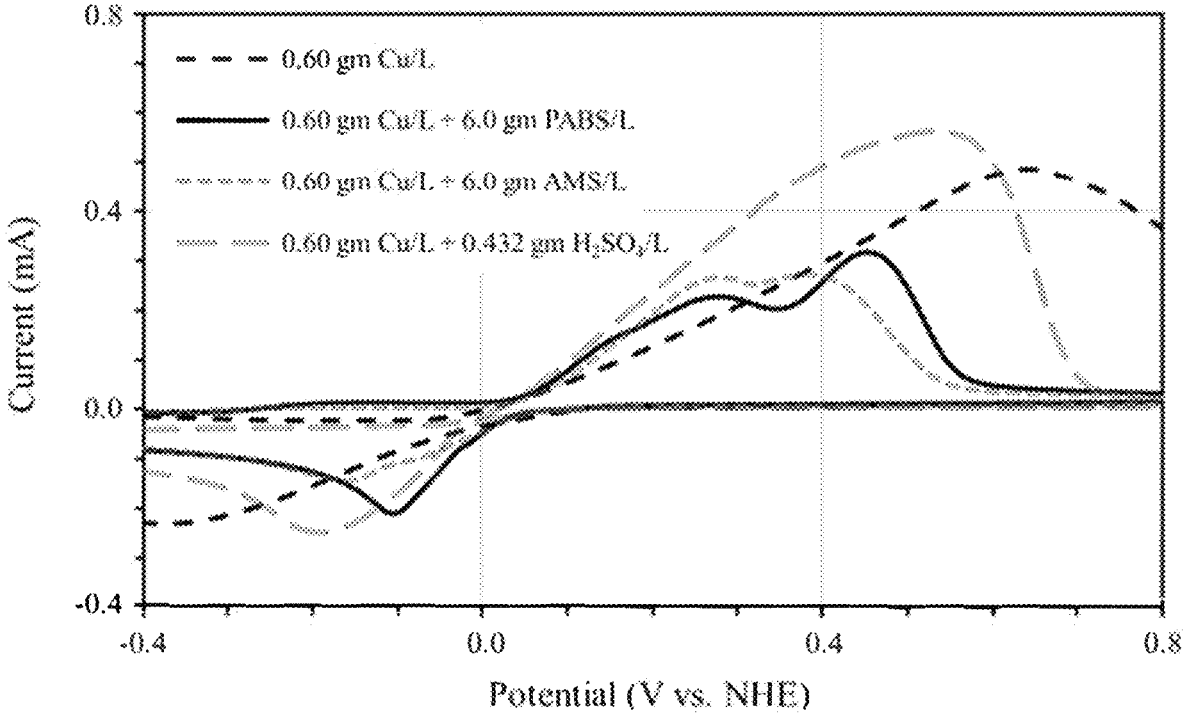
FIG. 1 is the cyclic voltammogram of a copper sulfate solution, copper sulfate with PABS, copper sulfate with ammonium sulfate, and copper sulfate with sulfuric acid.

Disclosed herein are methods for applying one or more metals to a substrate, wherein the metal application is facilitated by the presence of molecular structures referred to herein as polyammonium bisulfates. Also disclosed herein are metal-treated surfaces formed by the methods described herein.

As described in U.S. Pat. Nos. 9,938,171, 10,544,055, and 10,807,889, molecular clusters of ammonium sulfate and ammonium bisulfate can be formed by mixing anhydrous liquid ammonia and sulfuric acid with water flowing through a process line to form a mixed fluid, cooling the mixed fluid, for example by flowing the mixed fluid through a heat exchanger, and combining the cooled mixed fluid with a second portion of sulfuric acid. The product is an aqueous solution including sulfuric acid and stable, three-dimensional molecular structures composed of ammonium sulfate, ammonium bisulfate, sulfuric acid, and water, which can be represented by Formula I:

$$((NH_4)_2SO_4)_a(H_2SO_4)_b(H_2O)_c(NH_4HSO_4)_x. \quad (I)$$

wherein a is at least 1, b is at least 1, c is at least 1, and x is at least 1. Alternatively, in some examples, a is from 1 to 5 or from 1 to 3; b is from 1 to 5 or from 1 to 3; c is from 0 to 5, from 1 to 5, or from 1 to 3; and x is from 1 to 20, from 1 to 10, or from 1 to 6. Molecules of Formula I are referred to herein as polyammonium bisulfates or "PABS."

Described herein are methods of applying metals to substrates, where the methods include contacting the substrate with an aqueous metal plating composition comprising polyammonium bisulfate ("PABS") and a dissolved metal or salt thereof. The methods allow application of metals to the substrate without need for electrical energy input or for an added chemical catalyst, chelating agent, complexing agent, reducing agent, stabilizer, or pH-modifying (or controlling) chemical compound. Accordingly, in some examples, the method does not include one or more of an electrical current, a catalyst, a chelating agent, a complexing agent, a reducing agent, a chemical stabilizer, or a pH-controlling buffer. In some examples, the method does not include any of an electrical current, a catalyst, a chelating agent, a complexing agent, a reducing agent, a chemical stabilizer, or a pH-controlling buffer. In alternative embodiments, however, the methods described herein can be improved by including one or more additives selected from the group comprising electrical energy, chemical catalyst, reducing agent, stabilizer, chelating agent, or a pH-modifying (or controlling) chemical compound in order to enhance the composition and/or quality of the coating layer as well as provide the benefit of using less energy, less additive chemicals, or generating less hazardous waste.

As described herein, a method of applying a metal to a substrate includes contacting the substrate with an aqueous metal plating composition comprising polyammonium bisulfate ("PABS") and at least one dissolved metal or salt thereof; allowing the metal to deposit on the substrate in a layer; and rinsing the substrate with water to form a metal-treated substrate. In some examples, the method further includes a second contacting step with a second aqueous metal plating composition comprising PABS and at least one dissolved metal or salt thereof, a second depositing step, and optionally a second rinsing step. The metals in the first and second contacting steps can be the same or different. In further examples, the method can include additional contacting, depositing, and/or rinsing steps. When a method includes more than one step of contacting a substrate with an aqueous metal plating composition comprising PABS and at least one dissolved metal or salt thereof, the dissolved metals used in the different steps can be the same or different.

In the disclosed metal plating methods, the substrate can be any object or material, including but not limited to a metal, ceramic, plastic, or a one-dimensional metal, such as graphene. In some examples, the substrate is an insulating material. In other examples, the substrate is a metal, such as but not limited to wrought iron, cast iron, steel, including carbon steel, steel, stainless steel, aluminum, magnesium, copper, zinc, titanium, nickel, cobalt, tin, lead, silicon, and alloys thereof. When the substrate is a plastic, non-limiting examples of the plastic include acrylonitrile butadiene styrene (ABS), phenolic, urea formaldehyde, polyethersulfone, polyacetal, diallyl phthalate, polyetherimide, polytetrafluoroethylene, polyarylether, polycarbonate, polyphenylene oxide, mineral reinforced nylon (MRN), polysulfone, and combinations thereof.

In examples of the disclosed methods, the substrate is contacted with an aqueous metal plating composition comprising PABS, as defined herein, and a dissolved metal or salt thereof. In various examples of the first aspect, the dissolved metal can be silver (Ag), gold (Au), bismuth (Bi), chromium (Cr), copper (Cu), iron (Fe), iridium (Ir), molybdenum (Mo), nickel (Ni), palladium (Pd), platinum (Pt), rhodium (Rh), ruthenium (Ru), tin (Sn), titanium (Ti), zinc (Zn), or a combination thereof. In some examples, the metal is a noble metal. As used herein, metals that are noble are the elements gold (Au), iridium (Ir), osmium (Os), palladium (Pd), platinum (Pt), rhodium (Rh), ruthenium (Ru), and silver (Ag). Thus, in some examples, the dissolved metal is gold (Au), iridium (Ir), osmium (Os), palladium (Pd), platinum (Pt), rhodium (Rh), ruthenium (Ru), or silver (Ag). In some examples, the aqueous metal plating composition comprises two or more dissolved metals or salts thereof.

The aqueous metal plating composition includes a dissolved metal or salt thereof in a concentration of from about 0.001% (w/w) to about 25% (w/w), such as from about 0.001% (w/w) to about 10% (w/w), from about 0.01% (w/w) to about 10% (w/w), from about 0.05% (w/w) to about 5% (w/w), or from about 0.1% (w/w) to about 0.5% (w/w). When the aqueous metal plating composition includes two or more dissolved metals, each dissolved metal can be present in a concentration of from about 0.001% (w/w) to about 25% (w/w), such as from about 0.01% (w/w) to about 10% (w/w), from about 0.05% (w/w) to about 5% (w/w), or from about 0.1% (w/w) to about 0.5% (w/w). In some examples, increased concentrations of PABS are used to increase the amount of deposition of a metal onto an object or material if the amount of said metal in the solution is relatively low, e.g., about 0.001% (w/w) to about 0.2% (w/w).

The aqueous metal plating composition includes PABS in a concentration of from about 0.01% to about 50% (w/w) PABS, for example from about 1% to about 35% (w/w), from about 1% to about 25% (w/w), from about 1% to about 15% (w/w), from about 1% to about 10% (w/w), from about 1% to about 5% (w/w), from about 2% to about 5% (w/w).

In some examples, the aqueous plating composition is at a temperature in a range of from about 0° C. to about 100° C., such as from about 10° C. to about 80° C., or from about 30° C. to about 70° C. In some examples, it can be advantageous to use a higher temperature, so optionally, the aqueous plating composition can be at a temperature in a range of from about 40° C. to about 100° C. In some examples, the aqueous composition comprises a pH below about 2.

In examples of the disclosed methods, the step of contacting the substrate with the aqueous metal plating composition can be accomplished by immersion, spraying, applying a foam or gel, micro-droplet deposition, nanoprinting, or application with an automated or manual brush or mechanical device In some examples, the contacting step includes applying the aqueous metal plating composition to a first surface area of the substrate and omitting the aqueous composition from a second surface area of the substrate, thereby forming a metal pattern on the substrate. The metal pattern can be a decorative element to enhance aesthetics of the substrate or a functional element, such as a continuous metal path for conducting an electrical current. In some examples, a metal pattern formed on a substrate has a width in a range of from about $1\times10^{-10}$ m to about $1\times10^{-2}$ m, such as from about $2.5\times10^{-10}$ m to about $1\times10^{-3}$ m, or from about $1\times10^{-10}$ m to about 10 mm.

In some examples, the methods described herein apply a metal to a surface with the purpose of imparting a desired property or characteristic, e.g., corrosion resistance, hardness, or the ability to conduct more efficiently an electrical current along a specific path, among others. The methods disclosed herein are particularly useful for applying a metal layer as a cladding to protect another metal and/or when with a desired thickness or quality to an object or material.

This disclosure also provides methods for coating the surface or a defined area of a metallic substrate without a catalyst, or an electrical energy input. In some examples, the substrate is a metallic substrate, and the contacting step comprises a process selected from the group consisting of immersion, spraying, a foam or gel, micro-droplet deposition, nanoprinting, or application with an automated or manual brush or mechanical device.

The invention also relates to using polyammonium bisulfate to apply at least one metal to the surface of an object or material in combination with other additives such as levelers, brightening agents, and the like that are commonly used to impart specific characteristics to the finished surface layer. In some examples, the aqueous metal plating composition further comprises the aqueous metal plating composition further comprises an additive, such as thiourea, thiosulfate, citrate, 4-mercaptobenzoic acid, polyethylene glycol, sodium polyanethole sulfonate, oxyanions, or metal cations. In some examples, the additive is added to the treated substrate with the metal.

The disclosure also relates to applying two or more metals or metal salts dissolved in an aqueous solution of polyammonium bisulfate as a means of co-depositing said metals onto the surface of an object or material. In some examples an aqueous metal plating composition includes two or more dissolved metals or salts thereof. In some of those examples, the first metal comprises a first standard reduction potential, and the second metal comprises a second standard reduction potential, and the difference in the first and second standard reduction potentials is in a range of from about 0 V to about 2 V. The differences in standard reduction potentials allow for predicting if metal plating is energetically favored. In some examples, an aqueous metal plating composition comprises at least two dissolved metals or salts thereof, and the method further comprising, before rinsing the substrate, raising a temperature of the aqueous metal plating composition to a temperature in the range of about 40° C. to about 100° C. to form an alloyed surface, i.e., a final coating comprised of an alloy of a desired composition.

In any example of a method described herein, the aqueous solution used as a metal plating composition described herein includes PABS and a dissolved metal or salt thereof. Optionally, the aqueous solution further includes sulfuric acid. In some examples, the aqueous solution further includes one or more acids selected from acetic acid ($CH_3COOH$), ascorbic acid ($C_6H_8O_6$), formic acid ($CH_2O_2$), hydrochloric acid (HCl), maleic acid ($C_4H_4O_4$), methanesulfonic acid ($CH_3SO_3H$), nitric acid ($HNO_3$), oxalic acid ($CO_2HCO_2H$), phosphoric ($H_3PO_4$), sulfuric acid ($H_2SO_4$), and toluene sulfonic acid ($CH_3C_6H_4SO_3H$). In some examples, the aqueous solution further comprises an inorganic acid other than sulfuric acid (e.g., phosphoric acid [$H_3PO_4$], phosphonic acid [$H_3PO_3$], nitric acid [$HNO_3$], hydrochloric acid [HCl], or methane sulfonic acid [$CH_4O_3S$], among others). Optionally, the aqueous solution includes at least one reducing agent, such as ascorbic acid, oxalic acid, glyoxylic acid, glycolic acid, glucose, saccharose, polyphenols, butylamine, tartrate, formaldehyde, formic acid, maleic acid, ethanolamines, hypophosphite, hydrazine, hydroxylamine, hydrogen peroxide, borohydride, aminoboranes, sulfite salts, thiosulfate salts, cobalt-containing salts, iron-containing salts, tin-containing salts, vanadium-containing salts, titanium-containing salts, or a combination thereof. Optionally, the aqueous metal plating composition includes a chelating agent and/or complexing agent, such as ethylenediamine, tartrate salts, alkanol amines (e.g., N,N,N',N'-tetrakis-(2-hydroxypropyl)-ethylene diamine or related compounds), ethylenediamine tetraacetic acid (EDTA) or related compounds, sulfite salts, thiosulfate salts, saccharose, oxalic acid, ethylenediaminetetraacetate salts, citrate salts, tartrate salts, formate salts, glucose, or a combination thereof.

In any example of a method described herein, the aqueous solution can have a pH below about 2. Optionally, the solution has a concentration of the PABS from about 1% (w/w) to about 50% (w/w) in the solution.

In any method described herein, the substrate can be a non-metal. In some examples, a metal coated onto a non-metallic object or material is selected from the group comprising silver (Ag), aluminum (Al), gold (Au), bismuth (Bi), chromium (Cr), copper (Cu), iron (Fe), iridium (Ir), molybdenum (Mo), nickel (Ni), osmium (Os), lead (Pb), palladium (Pd), platinum (Pt), rhodium (Rh), ruthenium (Ru), tin (Sn), tellurium (Te), titanium (Ti), tungsten (W), and zinc (Zn). In one example of the method described herein, gold can be plated onto a two-dimensional material such as graphene. As detailed in the examples, it was surprisingly discovered that an aqueous solution comprised of PABS, an acid, water, and $AuCl_3$ easily and efficiently coated dissolved Au onto a layer of graphene.

In an embodiment, copper is particularly suitable because it is widely used in many industries for a range of applications. For example, circuit board vias and microvias, either blind or buried, can be coated or filled completely with pure copper by the method described in herein.

When a dissolved metal is to be coated onto a metallic object or material, persons skilled in the art will understand that the standard reduction potentials of the dissolved metal and the metal substrates must be considered. In some examples, the metal applied to a metallic object or material is selected from the group of noble metals. As used herein noble metals are the elements gold (Au), iridium (Ir), osmium (Os), palladium (Pd), platinum (Pt), rhodium (Rh), ruthenium (Ru), and silver (Ag). As detailed herein, an aqueous solution comprising PABS and a noble metal or noble metal salt, will plate onto a less noble metal surface. As detailed in the examples, an aqueous PABS solution amended with silver (Ag) efficiently plates a copper or copper alloy with a layer of silver (Ag). In some embodiments, the copper or copper alloy can be treated with an aqueous PABS solution containing nickel (Ni) to form a Ni-underplate before a coating of silver is applied. It is well known in the prior art that palladium and palladium alloys provide a protective coating for copper and some copper alloys. Therefore, one skilled in the art would recognize that wide variety of objects and materials composed of less noble elements and alloys thereof could be coated with more noble elements by applying a PABS-containing formulation comprised of PABS, water, a noble element or salt of said noble element, and optionally, an acid Methods described herein can be used to apply two or more metals or metal salts to a substrate sequentially. As explained above, when a method includes more than one step of contacting a substrate with an aqueous metal plating composition comprising PABS and at least one dissolved metal or salt thereof, the dissolved metals used in the different steps can be the same or different. When the metals used in sequential contacting steps are different metals, the second metal can replace the first metal layer formed by the first metal or the second metal can form a second metal layer on top of the first metal layer. In some examples, after a substrate is contacted with a first aqueous metal plating composition comprising a first metal (or salt thereof) to form a metal-treated substrate, the method further comprises contacting the metal-treated substrate with a second aqueous metal plating composition comprising a second metal (or salt thereof). In some examples, the second metal or salt thereof is present in the second aqueous metal plating composition in a concentration of about 0.001% (w/w) to about 10% (w/w), preferably 0.01% (w/w) to 5% (w/w), more preferably 0.05% (w/w) to 0.5% (w/w). In some examples, the second metal is selected from the group consisting of silver (Ag), gold (Au), bismuth (Bi), chromium (Cr), copper (Cu), iron (Fe), iridium (Ir), molybdenum (Mo), nickel (Ni), palladium (Pd), platinum (Pt), rhodium (Rh), ruthenium (Ru), tin (Sn), titanium (Ti), zinc (Zn), and combinations thereof.

In still other examples, the substrate is a metallic substrate, and after the metallic substrate is contacted with a first aqueous metal plating composition comprising a first metal (or salt thereof) to form a substrate having a layer of the first metal, the method further comprises contacting the first metal-treated substrate with a second aqueous metal plating composition comprising a second metal (or salt thereof). If second metal has a higher standard reduction potential than the first metal, the second contacting step forms a layer of the second metal on top of the layer of the first metal. Subsequent contacting steps using the same metal, or a different metal can be conducted until the layers build up a desired thickness or until a desired number of layers is reached.

The methods described herein can be used to form a metal coating on a pre-selected area of a surface or to the entirety of an object's surface area. As explained above, methods described herein can be used to form a metal pattern on a substrate. Alternatively, the methods can be used to coat the entirety of a surface. In some examples, it may be desirable to apply a metal in a predetermined pattern such as one or more straight lines, curved lines, or lines in specific patterns that are separate by uncoated or non-metallic-coated regions or areas of the surface of an object or material. In some examples, it may be desirable to coat the entirety of an internal or external surface of an object, such as the interior surface of a pipe. In some examples, the substrate is a metal object or a combination of metal objects, such as a pipe, pipefitting, valve, storage tank, or other component of a fluid transport system. Examples of fluid transport systems include systems used to transport water, liquid petroleum products (such as gasoline, oil, crude petroleum, liquid propane, water, or a related liquified material), or gases (such as hydrogen, methane, ethane, propane, butane, and combinations thereof). In some examples, the substrate is a circuit board. Thus, in some examples, the substrate is a metallic object, and the contacting step comprises applying an aqueous metal plating composition to an interior surface of the metallic object, wherein the metallic object is selected from the group consisting of pipes, pipe-fittings, valves, storage tanks, and other components of systems used to transport water, liquid petroleum products, or gases. Optionally, the metallic object can include two or more metallic parts connected in a series, such as for transport of a liquid or gas.

Another aspect of the invention relates to pretreating an object or material with an aqueous solution of polyammonium bisulfate that is essentially free of metal ions as a means of conditioning the surface of said object or material to be coated with a metal or combination of metals in a single layer or in multiple layers. In some instances, conditioning a metal surface with an aqueous solution containing PABS allows for a high-quality metal coating on an object or material.

The present disclosure should be interpreted according to the definitions in the "Definitions Section" at the end of the specification. In case of a contradiction between the definitions in the "Definitions Section" at the end of the specification and other sections of this disclosure, the "Definitions Section" at the end of the specification section should prevail.

While the disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form illustrated, but on the contrary, the intention is to cover all modifications, equivalents and alternatives falling within the spirit and scope of the present disclosure as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include," "including," and "includes" mean including, but not limited to. Additionally, as used in this specification and the appended claims, the singular forms "a," "an," and "the" include singular and plural referents unless the content clearly dictates otherwise.

Unless defined otherwise, all technical and scientific terms used herein have the same meaning as is commonly understood by one of ordinary skill in the art to which this invention pertains. Although methods and materials similar or equivalent to those described herein can be used in the practice of the present invention, suitable methods and materials are described below. All patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference.

The scope of the present disclosure includes any feature or combination of features disclosed herein (either explicitly or implicitly), or any generalization thereof, whether or not it mitigates any or all the problems addressed herein. Accordingly, new claims may be formulated during prosecution of this application (or an application claiming priority thereto) to any such combination of features. With reference to the appended claims, features from dependent claims may be combined with those of the independent claims and features from respective independent claims may be combined in any appropriate manner and not merely in the specific combinations enumerated in the appended claims.

Definitions

As used herein the following terms have the following meanings:

The term "about," as used herein when referring to a measurable value such as an amount or concentration and the like, is meant to encompass variations of ±10%.

The terms or "acceptable," "effective," or "sufficient" when used to describe the selection of any components, ranges, dose forms, etc. disclosed herein intend that said component, range, dose form, etc. is suitable for the disclosed purpose.

Also as used herein, "and/or" refers to and encompasses any and all possible combinations of one or more of the associated listed items, as well as the lack of combinations when interpreted in the alternative ("or").

"Comprising" or "comprises" is intended to mean that the compositions and methods include the recited elements, but not excluding others. "Consisting essentially of" when used to define compositions and methods, shall mean excluding other elements of any essential significance to the combination for the stated purpose. Thus, a composition consisting essentially of the elements as defined herein would not exclude other materials or steps that do not materially affect the basic and novel characteristic(s) of the claimed invention. "Consisting of" shall mean excluding more than trace elements of other ingredients and substantial method steps. Embodiments defined by each of these transition terms are within the scope of this invention.

As used herein, process and processes are used to indicate a series of steps or actions that result in a desired outcome; a process may consist of a single step or action or multiple steps or actions. As described herein, process is used in the context of a series of steps or actions that result in metal atoms in solution migrating to the surface of an object or material and forming a solid layer of said metal.

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

As used herein, the terms "invention," "the invention," "this invention," and "the present invention" are intended to refer broadly to all subject matter of this patent application and the claims below. Statements containing these terms should be understood not to limit the subject matter described herein or to limit the meaning or scope of the patent claims below.

As used herein, the meaning of "room temperature" includes any temperature in the range of about 15° C. to about 30° C., preferably from about 21° C. to about 26° C.

As used herein, the term "chelating agent" refers to compounds widely known to form stable chemical associations with metals. Hence, as used herein, chemical associations based on coordinate bonds or ionic attractions are considered as chelating agents.

All ranges disclosed herein encompass both endpoints as well as any and all subranges subsumed therein. For example, a stated range of "1 to 10" includes any and all subranges between (and inclusive of) the minimum value of 1 and the maximum value of 10; that is, all subranges beginning with a minimum value of 1 or more, e.g., 1 to 6.1, and ending with a maximum value of 10 or less, e.g., 5.5 to 10.

As used herein, the formation of a layer of metal on an object or material as a result of the said metal moving from a soluble form in the PABS-containing metal plating solution to a solid form on said object or material is referred to as "plating," "coating," and "deposition." Furthermore, these terms are used in reference to a layer of a metal or metals on an object or material without regard to thickness or other physical or chemical parameter. Plating, coating, and deposition also refer to a single layer of a desired thickness or multiple layers of one or more of metals of a desired thicknesses onto an object or material composed partially or totally of an object or material. Also, as used herein, "coat" is used to refer to a layer of a metal or combination of metals applied to a surface of an object or material. Furthermore, coat may refer to a layer of a metal or combination of metals applied to a specific area or a surface in a defined or undefined pattern or the surface of an object or material in its entirety. For example, a metal coating may be in the shape of a line or ribbon on an object or material. Likewise, a metal coating may cover a portion of the total area of a predetermined section, portion, segment, or part of the surface of an object or material.

As used herein, "bath" refers to any sort of container that is materially-compatible with a solution used for cleaning, treating, rinsing, or other process step or stage used in metal plating. Likewise, the term "bath solution" refers to any specific liquid composition that is used in metal plating. For example, a plating bath solution is one in which an object or material is wetted with a metal plating solution that contains at least PABS and a metal or metal salt. An activation bath is one in which an object or material is wetted with an activation solution to prepare a surface for metal plating.

As used herein, the thickness of a metal layer plated onto the surface of an object or material is precise if exact measurements are made via optical or electron microscopic observation following appropriate calibration of the microscope or X-ray fluorescence analysis (XRF). XRF measurement was calibrated using standards with known thickness. Standards are certified foils of metal with same the chemical composition with the metal layer of interest.

As defined herein, regarding an object or material, the term "surface" refers to the outermost layer of a solid object or material. Surface refers to the totality of the outermost layer of the object or material or to specific portions or parts as well as to boundaries or walls of groves, holes, or other voids that may be present as a result of milling, construction, drilling, and the like.

As used herein, surfaces on the exterior or interior of a three-dimensional solid object or material can be partially or completely coated with a metal layer. "Partially" refers to a specific region, segment, portion, or area on a surface of an object or material. When used to describe an area coated with a metal applied by the methods described herein, it is understood that the metal may cover the entire said area or only one or more defined portions of said area as a result of the metal being applied in a specific pattern. For example, one or more PABS solutions containing specific metals may be applied in straight lines, curved lines, or lines in specific patterns that are separate by uncoated regions or areas of the surface of an object or material.

Unless the context indicates otherwise, it is specifically intended that the various features of the invention described herein can be used in any combination. Moreover, the disclosure also contemplates that in some embodiments any feature or combination of features set forth herein can be excluded or omitted. To illustrate, if the specification states that a complex or process comprises components A, B and C, it is specifically intended that any of A, B or C, or a combination thereof, can be omitted and disclaimed singularly or in any combination.

All numerical designations, e.g., pH, temperature, time, concentration, and molecular weight, including ranges, are approximations which are varied (+) or (−) by increments of 1.0 or 0.1, as appropriate, or alternatively by a variation of 10%. It is to be understood, although not always explicitly stated, that all numerical designations are preceded by the term "about." It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 500 should be understood to include the explicitly recited limits of about 1 and about 500, but also to include individual ratios such as about 2, about 3, and about 4, and sub-ranges such as about 10 to about 50, about 20 to about 100, and so forth. It also is to be understood, although not always explicitly stated, that the reagents and processes described herein are merely exemplary and that equivalents of such are known in the art may alternatively be used.

Although the invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent, or patent application was specifically and individually indicated to be incorporated herein by reference. In addition, citation or identification of any reference in this application shall not be construed as an admission that such reference is available as prior art to the present invention.

The foregoing paragraphs have been provided by way of general introduction and overview and are not intended to limit the scope of the following claims. The described embodiments, together with further advantages, will be best understood by reference to the following detailed description taken in conjunction with the accompanying drawings.

The practice by those skilled in the art of the present disclosure will employ, unless otherwise indicated, conventional techniques of preparing coating solutions and preparing surfaces to be coated with metals.

The detailed description contained herein is divided into specific sections only for the reader's convenience and disclosure found in any section may be combined with that in another section. Titles or subtitles may be used in the specification for the convenience of a reader, which are not intended to influence the scope of the present disclosure.

EXAMPLES

The following examples are included to demonstrate preferred embodiments. It should be appreciated by those of skill in the art that the techniques disclosed in the examples which follow represent techniques discovered by the inventor to function well in the practice of the disclosed embodiments, and thus can be considered to constitute preferred modes for its practice. However, those of skill in the art should, considering the present disclosure, appreciate that many changes can be made in the specific embodiments which are disclosed and still obtain a like or similar result without departing from the spirit and scope of the disclosed embodiments.

In many of the following examples, metal coupons, primarily cold-rolled steel coupons, were used. If other types of coupons were used, the type of metal is specified in the example description. The process for preparing metal coupons for use was as follows. The first stage of the process for preparing metal coupons for plating was washing with a 0.5% (w/w) solution of Alconox™ for one minute. The washed coupons were then rinsed with deionized water 10 times before being rinsed with acetone and allowed to air dry. After cleaning, the coupons were normally activated by immersing in a solution containing PABS, e.g., about 2.0% (w/w) to about 5.0% (w/w), and a secondary acid selected from sulfuric acid, e.g., about 3.0% (w/w) to about 6.0% (w/w), and oxalic acid, e.g., about 5.0% (w/w), for 1 minute. The coupons were then rinsed with deionized water, blotted dry, and immediately immersed in the desired plating solution for selected time intervals. After plating, the coupons were rinsed 10 times in deionized water and allowed to air dry. Deviations from this coupon preparation process are detailed in the example description.

Example 1: Impact of PABS on the Redox Potential of Copper Ions

The solutions were made by adding copper sulfate pentahydrate and PABS to deionized water to achieve the concentration in the description. The solutions were treated in an electrochemical cell comprising a glassy carbon electrode with active area of 0.07 $cm^2$ as a working electrode, platinum wire as counter electrode, and Ag/AgCl as reference electrode. Cyclic voltammogram was registered at a potential scan rate of 0.05 V/s between −1.6 V and 1.2 V. The pH of the solutions before and after treatment as well as oxidation-reduction potentials are summarized in Table 1. The positive shift in reduction potential indicates a favorable reduction process. At the same concentration of copper, an optimal shift of reduction potential of copper ions was observed with 6.0 g PABS/L in solution. The presence of double oxidation peaks suggested the formation of copper-containing species on the electrode surface during the oxidation process.

TABLE 1

Effect of PABS on the redox potential of copper ions. (V = volts. NHE = Normal Hydrogen Electrode)

| Description | pH before | pH after | Potential (V vs. NHE) Reduction | Potential (V vs. NHE) Oxidation |
|---|---|---|---|---|
| 0.60 gm Cu/L | 4.671 | 4.626 | −0.377 | 0.635 |
| 0.60 gm Cu/L + 0.1 gm PABS/L | 4.300 | 3.912 | −0.279 | 0.559 |
| 0.60 gm Cu/L + 0.3 gm PABS/L | 3.896 | 3.886 | −0.248 | 0.457 |
| 0.60 gm Cu/L + 0.6 gm PABS/L | 3.607 | 3.595 | −0.191 | 0.382 |
| 0.60 gm Cu/L + 2.0 gm PABS/L | 3.155 | 3.137 | −0.142 | 0.280 |
| 0.60 gm Cu/L + 6.0 gm PABS/L | 2.798 | 2.796 | −0.105 | 0.276, 0.448 |
| 0.60 gm Cu/L + 12.0 gm PABS/L | 2.562 | 2.581 | −0.224 | 0.472 |
| 0.60 gm Cu/L + 18.0 gm PABS/L | 2.457 | 2.485 | −0.179 | 0.382 |

Example 2: Comparison of the Effect of PABS, Ammonium Sulfate, and Sulfuric Acid on the Redox Potential of Copper Ions Solutions were made by adding copper sulfate pentahydrate and PABS or ammonium sulfate or sulfuric acid to deionized water to achieve the concentrations specified in Table 2 and FIG. 1. An electrochemical cell comprising a glassy carbon electrode with an active area of 0.07 $cm^2$ as a working electrode, platinum wire as counter electrode, and Ag/AgCl as reference electrode. Cyclic voltammogram was registered at a potential scan rate of 0.05 V/s between −1.6 V and 1.2 V. The pH of the solutions was summarized in Table 2. FIG. 1 depicts the cyclic voltammograms of a copper sulfate solution, copper sulfate with PABS, copper sulfate with ammonium sulfate, and copper sulfate with sulfuric acid. The solution with copper sulfate and PABS shows the most positive shift in reduction potential of copper ions.

TABLE 2

Compositions of copper (in $CuSO_4 \cdot 5H_2O$) solutions used to compare reduction potentials with the indicated additives.

| Solution Compositions and Concentrations: Cu (gm/L) | PABS* (gm/L) | AMS** (gm/L) | $H_2SO_4$ (gm/L) | pH before | pH after | Reduction potential of $Cu^{2+}$ (V vs. NHE) |
|---|---|---|---|---|---|---|
| 0.60 | — | — | — | 4.671 | 4.626 | −0.377 |
| 0.60 | 6.0 | — | — | 2.798 | 2.796 | −0.105 |
| 0.60 | — | 6.0 | — | 4.415 | 4.377 | −0.172 |
| 0.60 | — | — | 0.432 | 2.221 | 2.203 | −0.191 |

*PABS = Polyammonium Bisulfate
**AMS = Ammonium Sulfate

Figure 2:
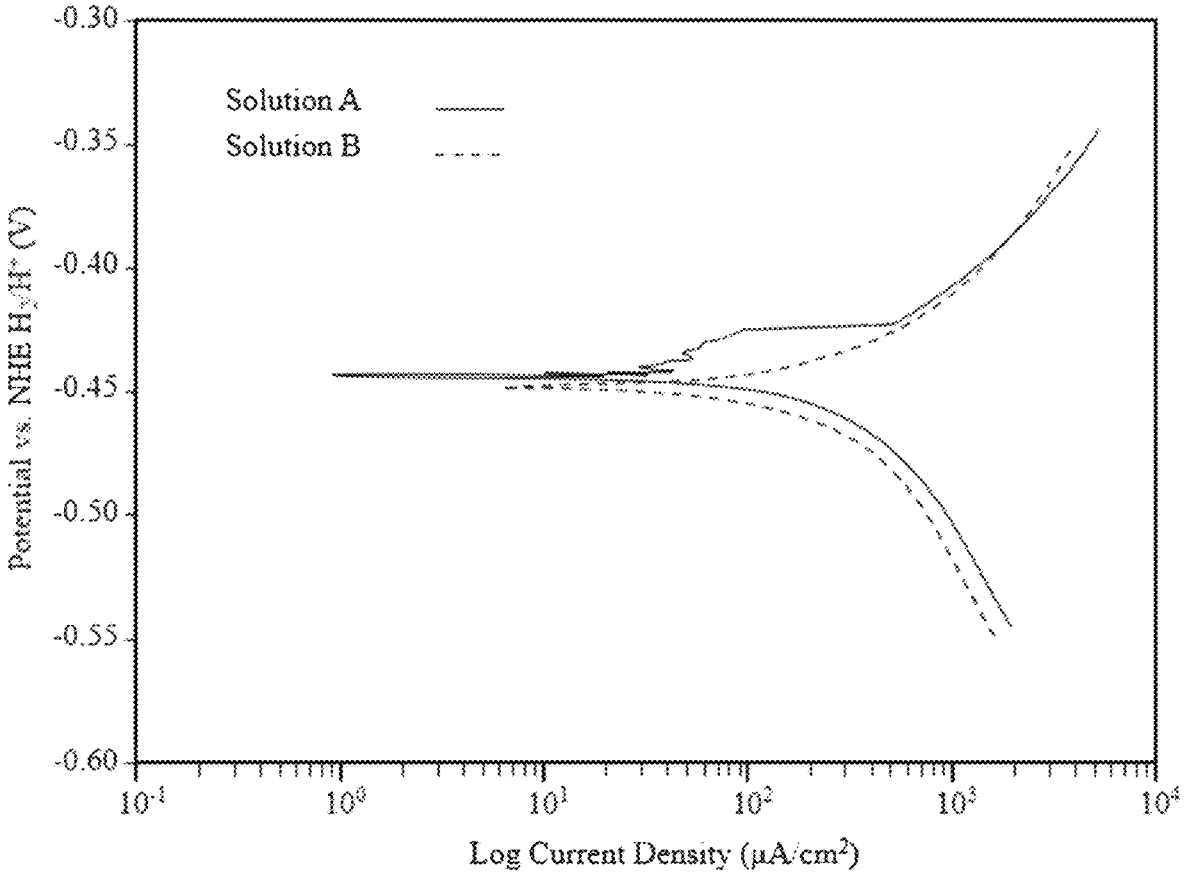
FIG. 2 are Tafel extrapolation plots of solution A (amended with PABS) and solution B (amended with sulfuric acid).

Example 3: Comparison of a Copper Solution with PABS and Sulfuric Acid with a Similar Copper Solution Amended with Sulfuric Acid FIG. 2 depicts Tafel extrapolation plots of solution A, a composition containing 0.39% (w/w) $CuSO_4 \cdot 5H_2O$, 3.6% (w/w) $H_2SO_4$ and 2.4% (w/w) PABS, and solution B, a solution containing 0.39% (w/w) $CuSO_4 \cdot 5H_2O$ and 2.46% (w/w) $H_2SO_4$. Both test solutions had pH values of 0.32. An electrochemical cell comprising a cold-rolled steel coupon with an active area of 5.6 $cm^2$ as a working electrode, platinum wire as counter electrode, and Ag/AgCl as reference electrode. Cold-rolled steel coupons prepared as described in Example 1 were immersed in either solution A or solution B for 60 minutes to plate a metallic copper film onto the coupon. An overpotential of +100 mV was applied to the electrochemical cell to determine the corrosion potential and the corrosion current density. Corrosion is defined as the rate of iron deterioration in solution. By applying an overpotential to an electrochemical cell, the reaction is shifted away from equilibrium. A positive overpotential results in anodic polarization and a negative overpotential results in cathodic polarization. Both anodic and cathodic polarization curves exhibit linear parts close to corrosion potential. By extrapolating the Tafel anodic and cathodic linear parts until they intersect, the corrosion potential—the corrosion current density point is defined. As illustrated in FIG. 2, the corrosion potential of solution A was higher than solution B. The positive shift of the corrosion potential suggests that copper plating on steel is easier in solution A than solution B. The corrosion current densities are 306.6 $\mu A/cm^2$ and 315.1 $\mu A/cm^2$ for solution A and solution B, respectively. Corrosion rate is proportional with the corrosion current density. Not intending to be bound by theory, the smaller corrosion current density indicates a lower iron dissolution rate or better coverage of a Cu film after 60-minutes plating in solution A.

Figure 3:
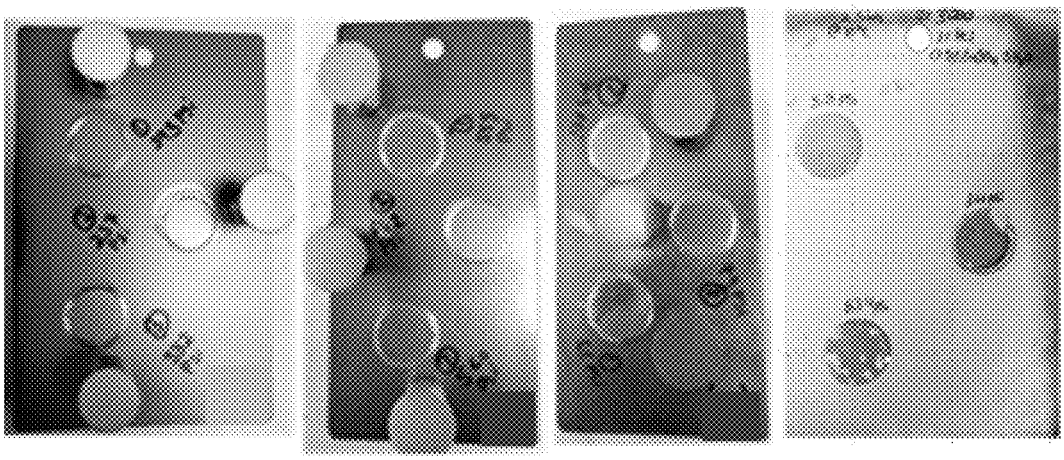
FIG. 3 is a collection of images of tested plated metal coatings according to the ASTM D4541 Standard Test Method for Pull-Off Strength of Coatings Using Portable Adhesion Testers. Each image is labeled based on its plated metal coating.

Example 4: Evaluating the Adhesion Strength of a Metal Coating Applied to Metal Coupons A Delfesko Positest™ was used to measure the adhesion strength of film deposited in accordance with ASTM D4541. An epoxy resin was used to adhere a 20 mm aluminum dolly to a plated surface. The sample was allowed to cure and age for at least 12 hours. A pneumatic piston was then connected to the free end of the dolly. The piston then pulled the dolly off with increasing pressure. The maximum value reached before bond failure was recorded as the failing pressure (expressed as pounds per square inch [psi]). FIG. 3 shows the results from this process. FIG. 3 shows the visual results when then epoxy fails. A zinc phosphate-coated plate was used for comparison. Two copper samples were plated using the following conditions. The first copper sample designated as "Thick" was achieved by using 1.98% (w/w) copper sulfate pentahydrate, 0.36% (w/w) sulfuric acid and 0.24% (w/w) PABS immersed for 20 seconds at room temperature. The second copper sample designated as "Thin" was then prepared by using a 0.2% (w/w) copper sulfate pentahydrate, 0.036% (w/w) sulfuric acid and 0.024% (w/w) PABS immersed for 5 seconds at room temperature. Table 3 lists the results from testing adhesion depicted in FIG. 3. Stainless steel plating occurred with copper sulfate pentahydrate 0.5% (w/w) addition of 3% (w/w) hydrochloric acid, 3.6% (w/w) sulfuric acid and 2.4% (w/w) PABS immersed for 2.5 hours at 70° C.

TABLE 3

Summary of adhesion strengths (psi) of metal coatings applied in accordance with the ASTM D4541 test protocol. Coatings of copper, designated "Thin" and "Thick," were applied as described herein.

| Sample | Zinc Sulfate | Copper "Thin" | Copper "Thick" | 304 Stainless Steel |
|---|---|---|---|---|
| Test 1 | 393 | 555 | 73 | 518 |
| Test 2 | 237 | 662 | 79 | 361 |
| Test 3 | 332 | 560 | 65 | 534 |
| Average | 321 | 592 | 72 | 471 |

Figure 4:
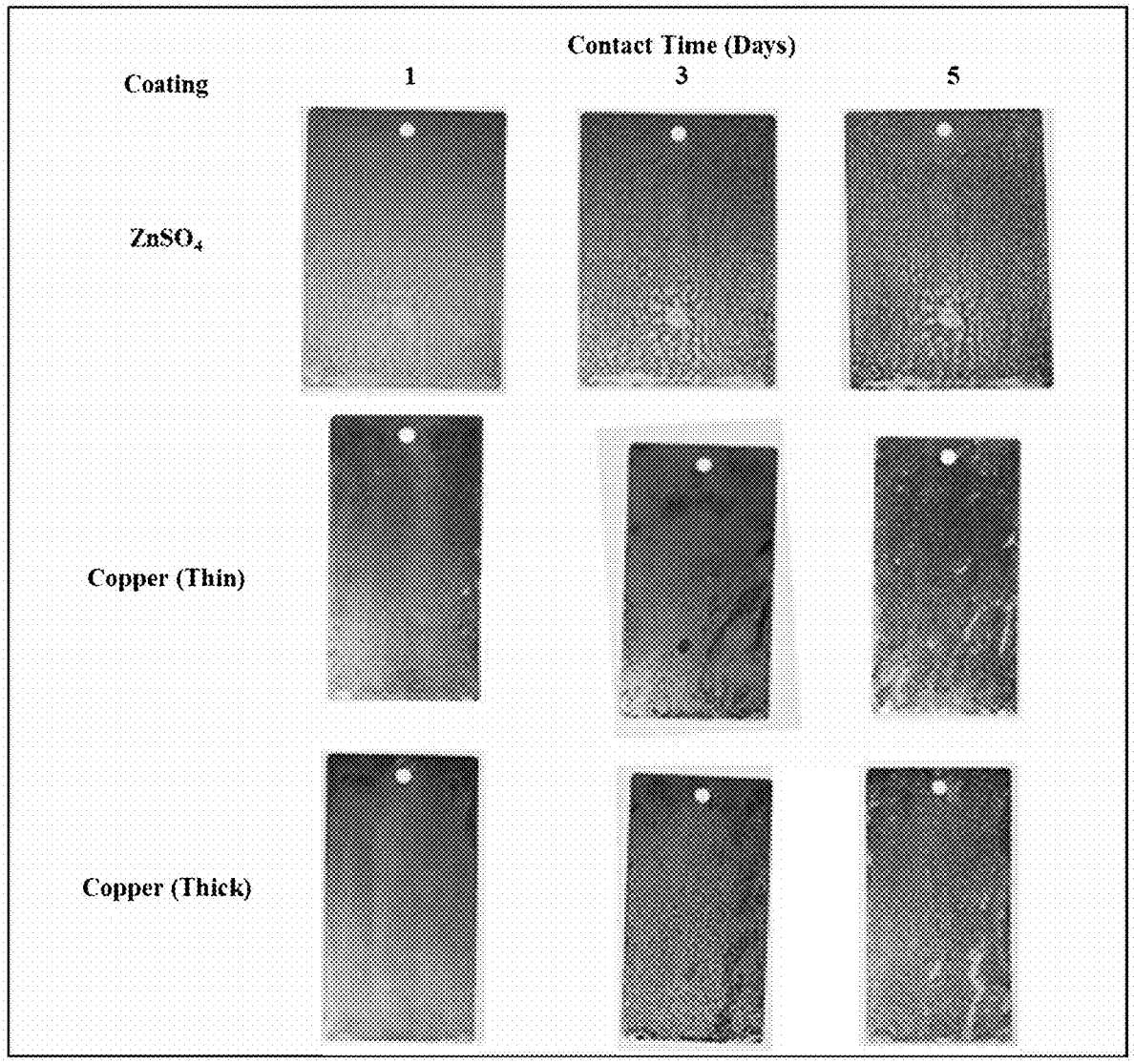
FIG. 4 are images depicting the corrosion resistance of coupons coated with different metals in a salt spray testing assay (ASTM B117).

Example 5: Studies to Determine Corrosion Resistance of Metal-Plated Coupons Using the ASTM B117 Method Samples were prepared according to the process previously described. The prepared samples were then subjected to salt brine spray over the course of 5 days. The plates were inspected and photographed at 1, 3 and 5 days. The results summarized in FIG. 4 indicated that the thick copper plating was more corrosion resistant than the thin copper plating sample and the zinc sulfate standard. Table 4 is summary of visual examinations and qualitative scoring of the degree of corrosion resistance of the test coupons.

TABLE 4

Summary of qualitative scoring of corrosion resistance of metal plated coupons evaluated according to the ASTM B117 method.

| Coating | Qualitative Score (Day 5) |
|---|---|
| Zn $SO_4$ | +++ |
| Copper (Thick Coating) | +++ |
| Copper (Thin Coating) | + |

Figure 5A:
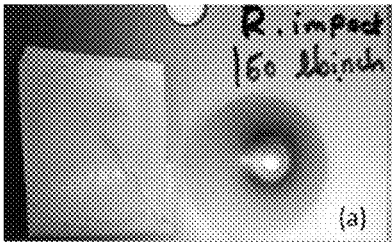
FIGS. 5A, 5B, and 5C are a collection of images summarizing impact ball test results.
Figure 5B:
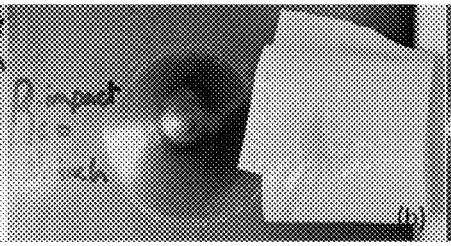
Figure 5C:
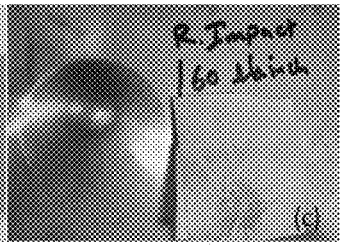

Example 6: Evaluating the Susceptibility of Plated Copper to Delaminating, Evaluated According to the ASTM D2794 Protocol This protocol is based, in part, on the use of a steel ball to impact a surface in a manner to impart a 160 lb per inch impact on the test surface. When the steel ball strikes the metal, a dent is made. A zinc phosphate-coated plate was used for comparison. Two copper samples were plated using the following conditions. The first copper sample designated as "Thick" was achieved by using 1.98% (w/w) copper sulfate pentahydrate, 0.36% (w/w) sulfuric acid and 0.24% (w/w) PABS immersed for 20 seconds at room temperature. The second copper sample designated as "Thin" was then prepared by using a 0.2% (w/w) copper sulfate pentahydrate, 0.036% (w/w) sulfuric acid and 0.024% (w/w) PABS immersed for 5 seconds at room temperature. Applying a tape test reveals which sample showed the greatest delamination. The results of this test are summarized FIGS. 5A-5C. The dents for the three test surfaces were similar as illustrated. The tape test results, visible in FIG. 5A [image on the left side] were similar for the zinc sulfate control coating and for the "thin" copper coating shown in FIG. 5B [center image], but the "thick" copper coating was easily removed in the tape test as shown in FIG. 5C [image on the right side]. Results of visual inspections and comparisons were used as the basis to score resistance to delamination on a scale of + to +++. A summary of qualitative assessments of the resistance to delamination of plated zinc and copper layers are summarized in Table 5.

TABLE 5

Summary of qualitative assessment of the resistance to delamination of the indicated metal coatings.

| Sample name | Results (Scale of + to +++) |
|---|---|
| Zinc Sulfate | +++ |
| Copper "Thin" Coat | +++ |
| Copper "Thick" Coat | + |

Example 7. Applying a Plating Solution to an Object or Material

Figure 6:
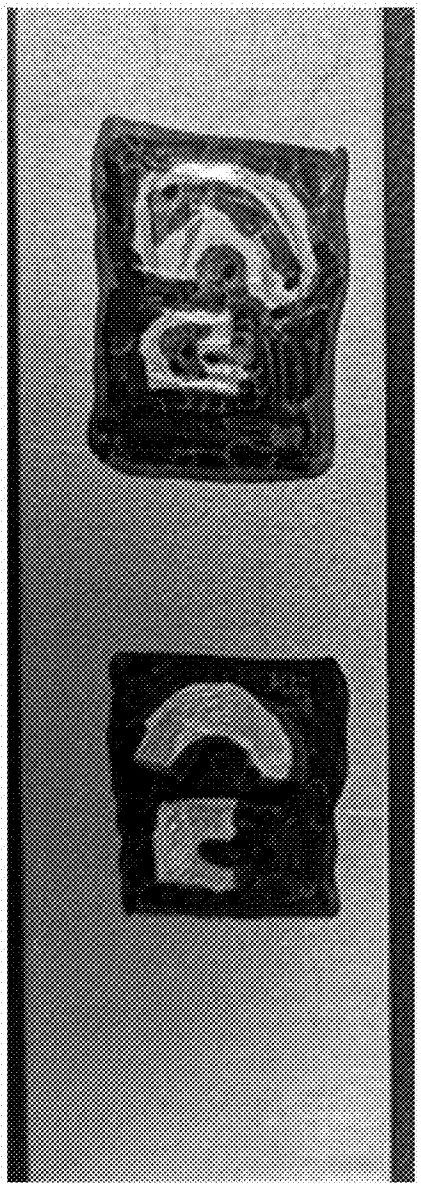
FIG. 6 illustrates copper plated in a narrow groove (left side of coupon) or directly onto the surface of the metal coupon in the selected pattern (right side of coupon).

As described herein, there are many methods to apply a plating solution to an object or material. Such methods range from complete immersion of an object or material into a plating solution to applying the metal-containing plating solution to a pre-selected area or region of a surface. As an example of such application methods, a copper plating solution was applied to a thin groove etched into the surface of a cold-rolled steel coupon. The surface of the coupon near the groove was coated with ink from a permanent laboratory marker to enhance visualization and providing contrast in photographs. The groove was filled with a 1.98% (w/w) $CuSO_4 \cdot 5H_2O$, 0.36% (w/w) sulfuric acid and 0.24% (w/w) PABS plating solution as described in prior examples. After 20 seconds, the plating solution was rinsed from the groove, the coupon was dried and photographed. As illustrated in FIG. 6 (left image), the groove etched in the form of two letters, C and u, to indicate copper was the plating metal. In FIG. 6 (right image), a syringe and needle were used to "free-hand" apply the plating solution to another cold-rolled steel coupon. After a contact time of 20 seconds, the coupon was rinsed, dried, and photographed. In this case, the plating was applied using a syringe and needle. Not intending to be bound by theory, this example shows that a metal-containing plating solution can be applied in methods other than immersion of an object or material.

Figure 7:
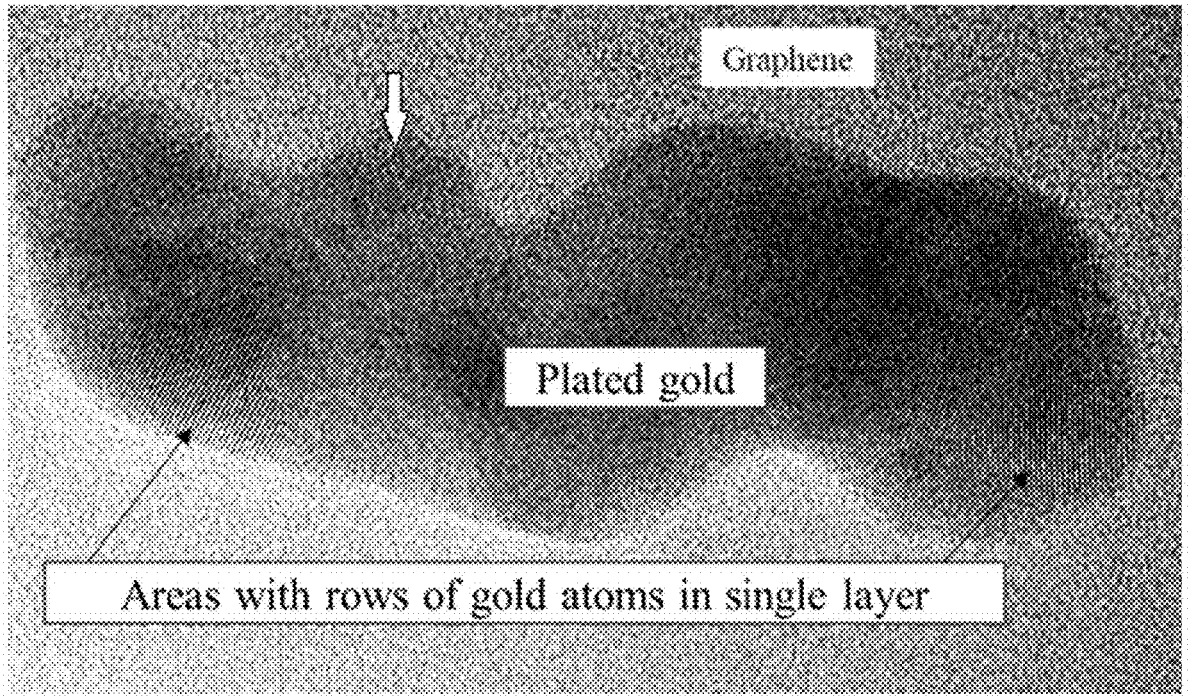
FIG. 7. is a high-resolution transmission electron micrograph illustrating the ability of gold to plate onto a layer of graphene using an unoptimized treatment process, where the black arrows identify single layers of monoatomic gold atoms and the white arrows identify more than one layer of gold atoms.

Example 8: Evaluating the Ability for PABS to Plate a Metal to a Non-Metallic Surface Using a Graphene Sheet as the Surface to be Coated with Gold Trivial transfer graphene was obtained (Advanced Chemical Suppliers, SKU #TTG10011) and prepared and transferred to a silicon wafer using instructions provided by Advanced Chemical Suppliers. To prepare the plating solution, 50 mg of gold trichloride (Sigma Aldrich SHU #334049) were dissolved in 3 mL of distilled water. An aliquot (250 μL) was added to 250 μL of a 50% (w/w) PABS/50% (w/w) sulfuric acid solution and mixed with manual agitation for 30 seconds. A negative control was prepared by adding 50 mg of gold trichloride to 3 mL distilled water, mixing well, and mixing 250 μL of this solution with 250 μL of a 50% (w/w) sulfuric acid solution. The blank and the sample solutions were then added dropwise with a transfer pipet to mounted graphene sheets. Alternatively, samples of the blank and plating solution were applied to graphene mounted to 4 mm TEM grids coated with lacey carbon (Advanced Chemical Suppliers, SKU #E23CL105). FIG. 7 is a high-resolution transmission electron microscope image showing an area of graphene coated with gold. Some regions of the plated gold are ordered rows of single layer gold atoms (see regions indicated by the black arrows). In other areas of the gold plated onto the graphene sheet, there were areas of more than one layer of gold atoms (see white arrow).

Example 9: Plating Gold onto Graphene Using the Process Described in Example 8

Figure 8:
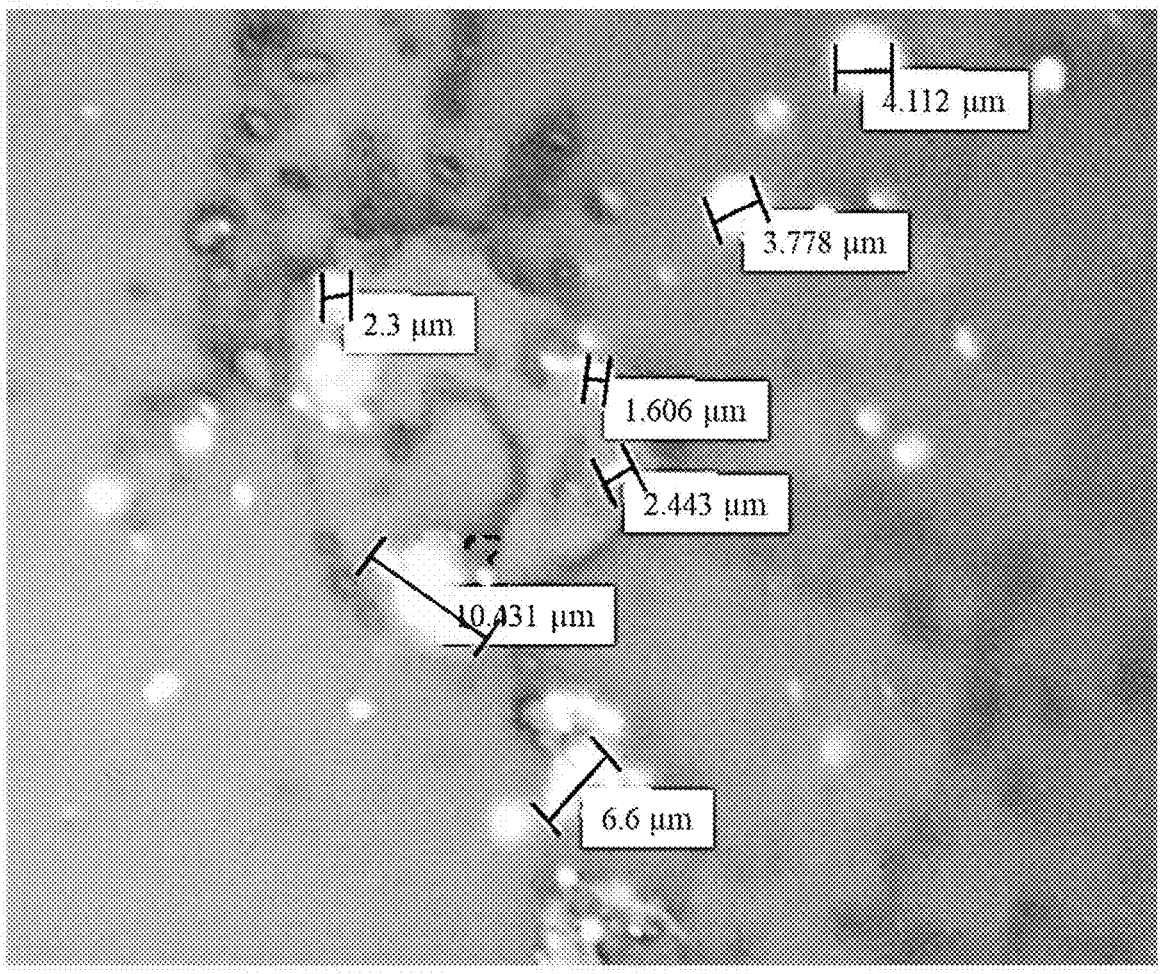
FIG. 8. is an image of gold plated onto graphene captured with an optical microscope at 200× magnification. The white areas with approximate diameters illustrate the patchiness of the gold plating resulting from an unoptimized plating process.

As illustrated in FIG. 8, the unoptimized plating process resulted in multiple plating areas of gold plated onto a graphene sheet that were visible with an optical microscope at 200× magnification. The white areas with approximate diameters illustrate the patchiness of the gold plating onto graphene. Not intending to be bound by theory, it is anticipated that uniform results can be obtained by optimizing the plating process.

Figure 9:
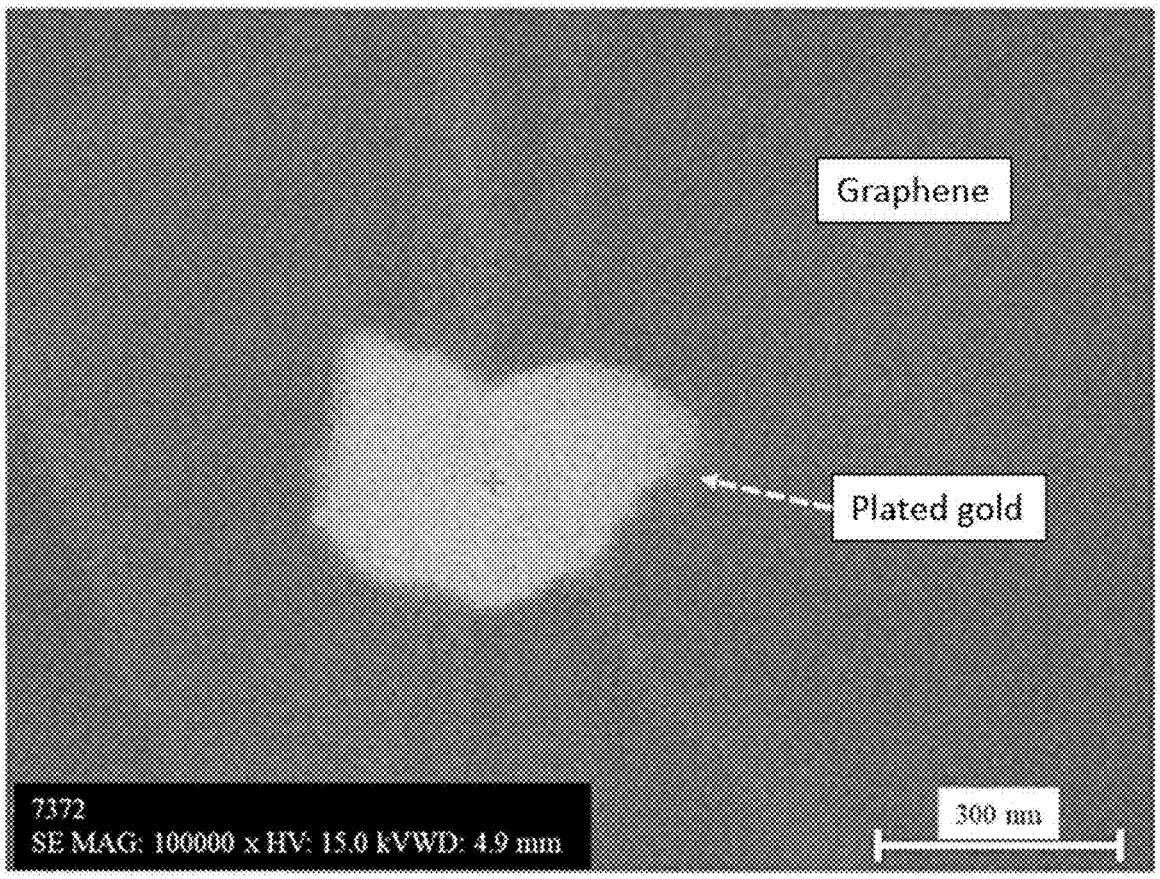
FIG. 9. is a high-resolution image of the area of the graphene where gold plated onto the surface analyzed by Energy-dispersive X-ray spectroscopy (EDS).
Figure 10:
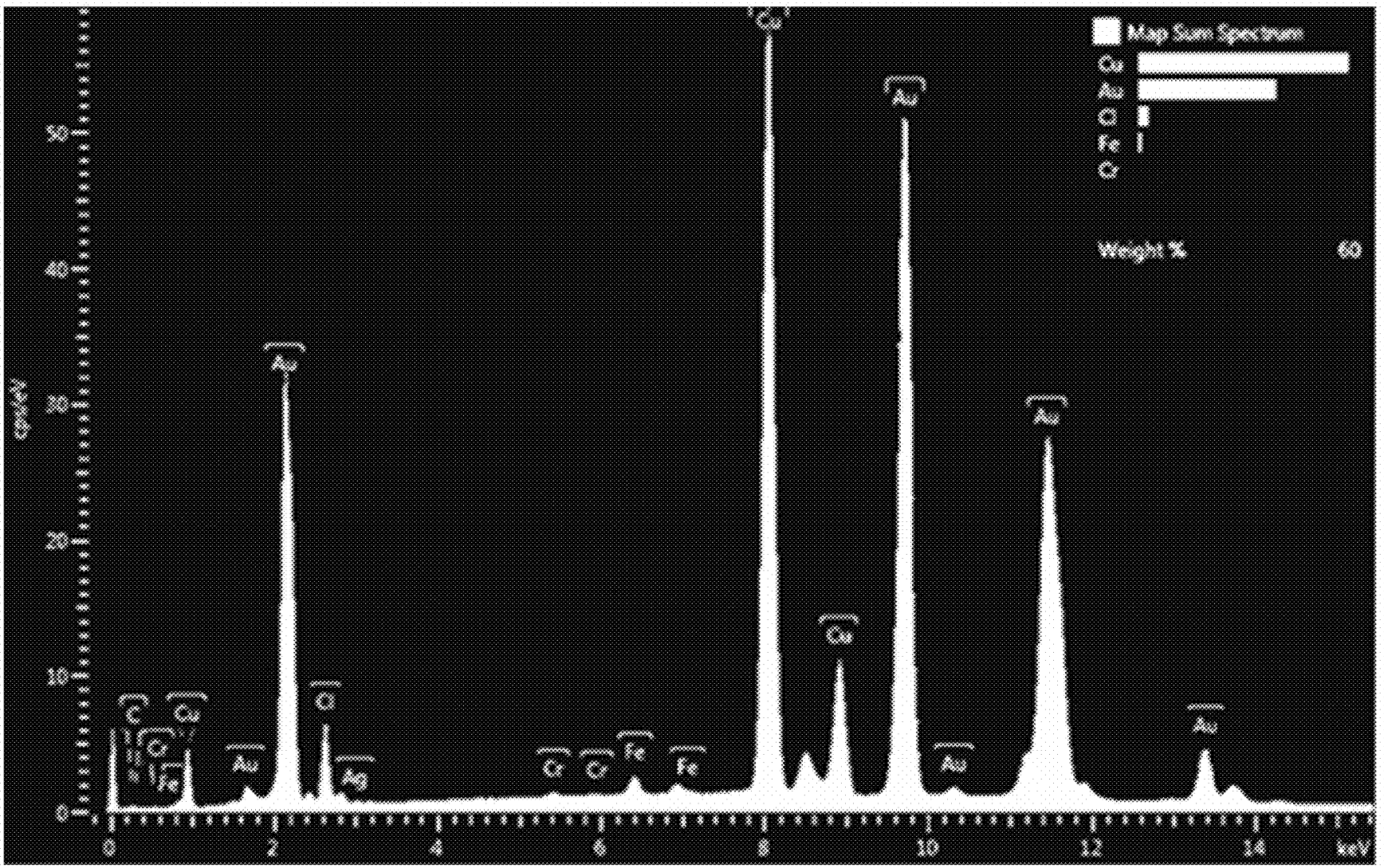
FIG. 10 is the Energy-dispersive X-ray spectroscopy (EDS) collected spectrum of gold plated onto graphene.

Example 10. Energy-Dispersive X-Ray Spectroscopy (EDS) to Analyze a Gold-Coated Surface Results of a TEM analysis of an area of graphene coated with gold are depicted in FIG. 9. The center of an area coated with gold (see crosshair) was analyzed using EDS. The resulting EDS spectrum is shown in FIG. 10 and demonstrates the presence of gold. The tabulated results from the spectrum are presented in Table 6. The tabulated results demonstrate the abundance of gold in the area plated with the PABS+gold plating solution. The absence of chlorine in the tabulated abundance results indicates that the starting material, gold chloride, was not present in the area plated with gold.

TABLE 6

Abundance results of elements at the center of an area coated with gold (see crosshair in FIG. 9) analyzed using energy-dispersive X-ray spectroscopy (EDS). Spectrum: Acquisition Date: Jun. 5, 2019 1:04:51 AM HV: 15.0 kV Puls th.: 2.09 kcps

| El | AN | Series | unn. C [wt. %] | norm. C [wt. %] | Atom. C [at. %] | Error (1 Sigma) [wt. %] |
|---|---|---|---|---|---|---|
| C | 6 | K-Series | 34.15 | 33.62 | 68.70 | 5.6 |
| O | 7 | K-Series | 15.13 | 14.90 | 22.86 | 2.7 |
| Al | 13 | K-Series | 1.53 | 1.51 | 1.37 | 0.1 |
| Cu | 29 | K-Series | 3.27 | 3.22 | 1.24 | 0.2 |
| Au | 79 | M-Series | 47.47 | 46.75 | 5.82 | 1.80 |
| | | Total: | 101.55 | 100.00 | 99.99 | |

Example 11. Ruthenium Plated onto Cold-Rolled Steel

Figure 11A:
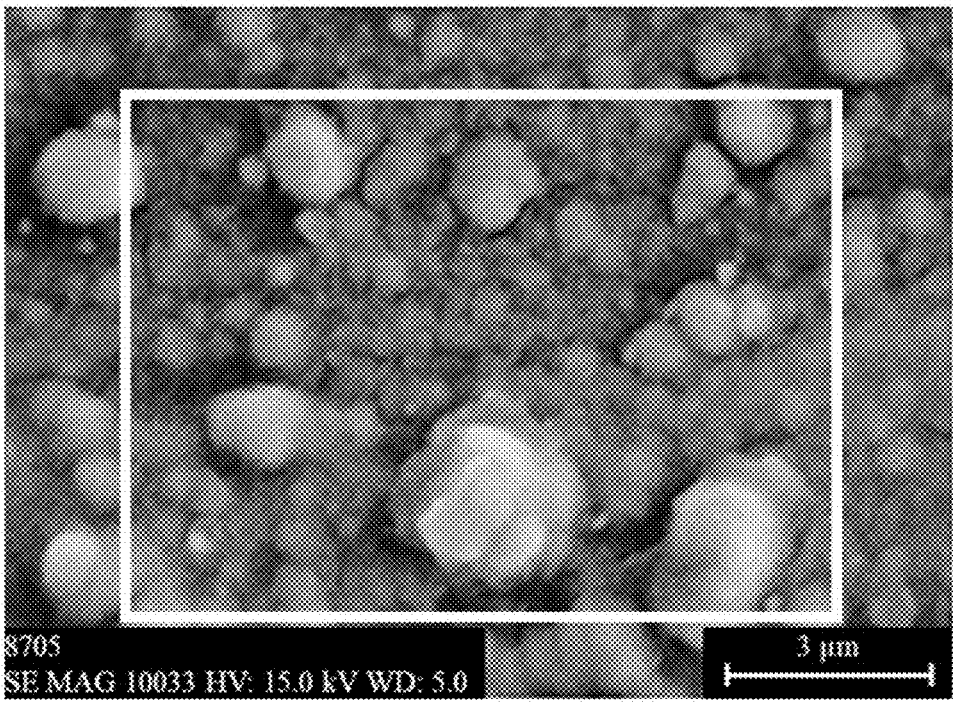
FIG. 11A is a scanning electron micrograph of the surface of a ruthenium coating plated onto cold rolled steel using an unoptimized process.
Figure 11B:
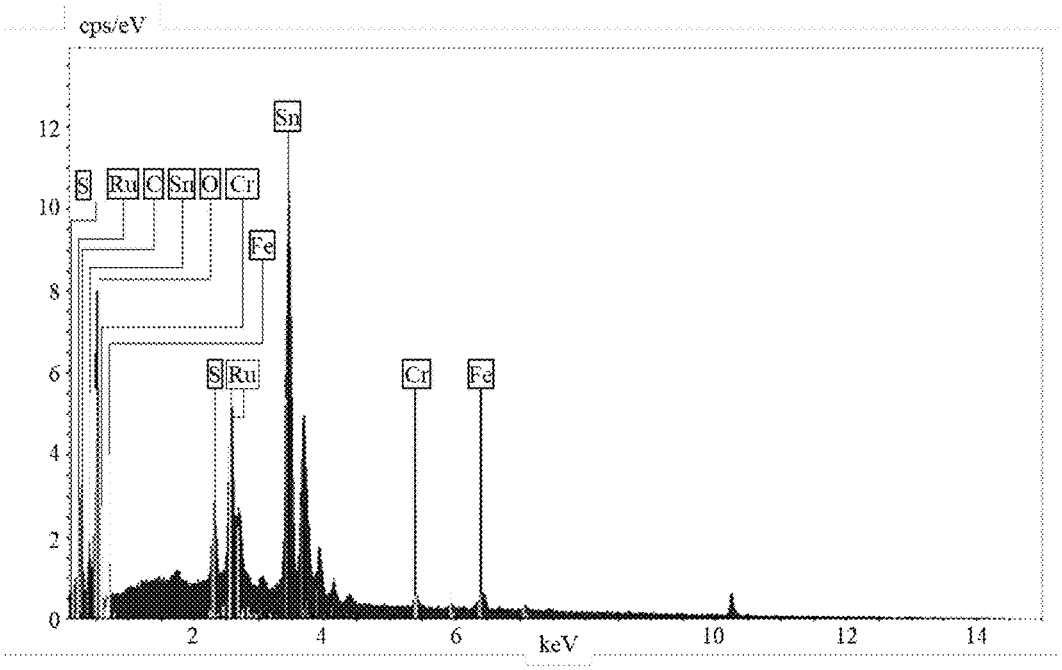
FIG. 11B is an Energy-X-ray spectroscopy (EDS) collected spectrum of ruthenium plated onto cold rolled steel.

A sample of cold-rolled steel coupon was washed and cleaned as previously described. A solution of 1% (w/w) ruthenium chloride was added 1:1 with a solution of PABS/$H_2SO_4$. The temperature of the plating bath was 90° C. because previous attempts to plate ruthenium at lower temperatures were unsuccessful. When the bath reached temperature, the cold-rolled steel coupon was immersed for one hour. The coupon was then removed from the heated bath and repeatedly rinsed with deionized water. FIG. 11A is an SEM image of ruthenium plated onto cold-rolled steel. FIG. 11B is the EDS spectrum for the ruthenium layer plated onto the cold-rolled steel coupon. Table 7 is a tabulation of the abundance of metals in the area evaluated (square area in FIG. 11A). Here, Ru represented 12.15% (w/w) of the composition.

TABLE 7

EDS spectrum summary of the abundance of the elements in a ruthenium coating on a cold-rolled steel coupon. Spectrum: Acquisition

| El | AN | Series | unn. C [wt. %] |
|---|---|---|---|
| O | 8 | K-Series | 27.51 |
| C | 6 | K-Series | 10.91 |
| Sn | 50 | L-Series | 40.24 |
| Ru | 44 | L-Series | 12.15 |
| Fe | 26 | K-Series | 3.02 |
| Sn | 16 | K-Series | 1.67 |
| Cr | 24 | K-Series | 0.91 |
| | | Total: | 96.41 |

Figure 12:
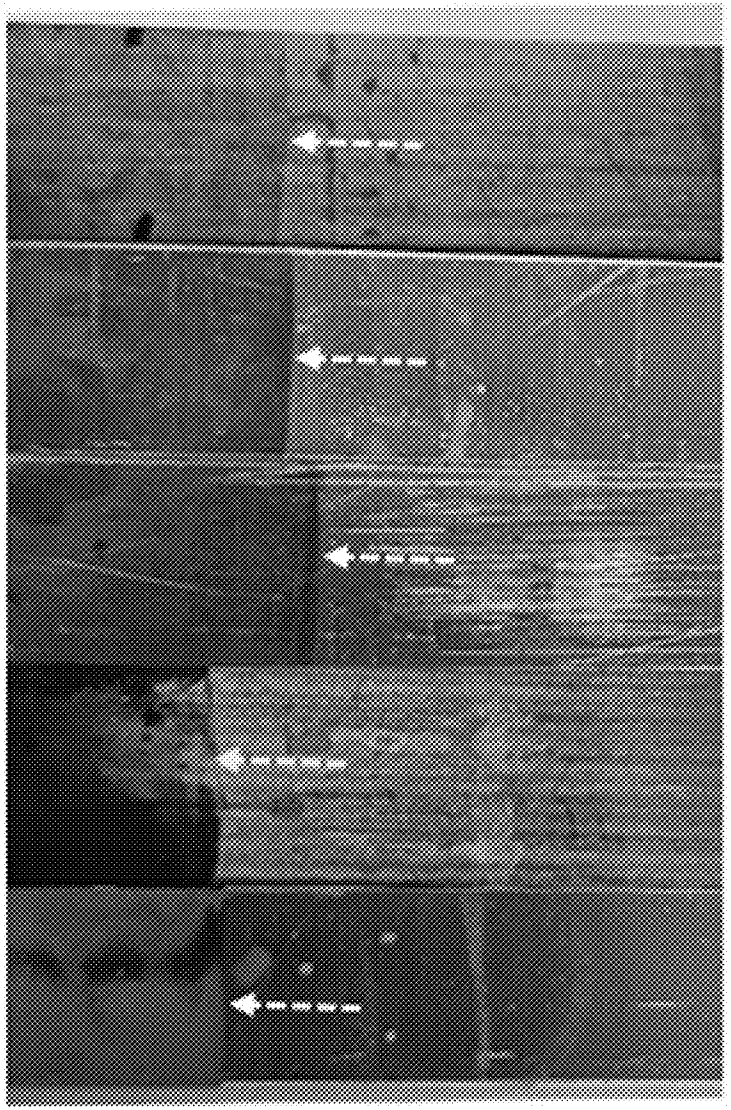
FIG. 12 are copper coupon images depicting a change of coloration after being submerged in a palladium-containing plating bath for specified periods of time. Coupons were treated (left to right) for 2 minutes, 3 minutes, 5 minutes, 10 minutes, and 20 minutes. The dashed arrows indicate the plating line which is the air-solution interface.
Figure 13:
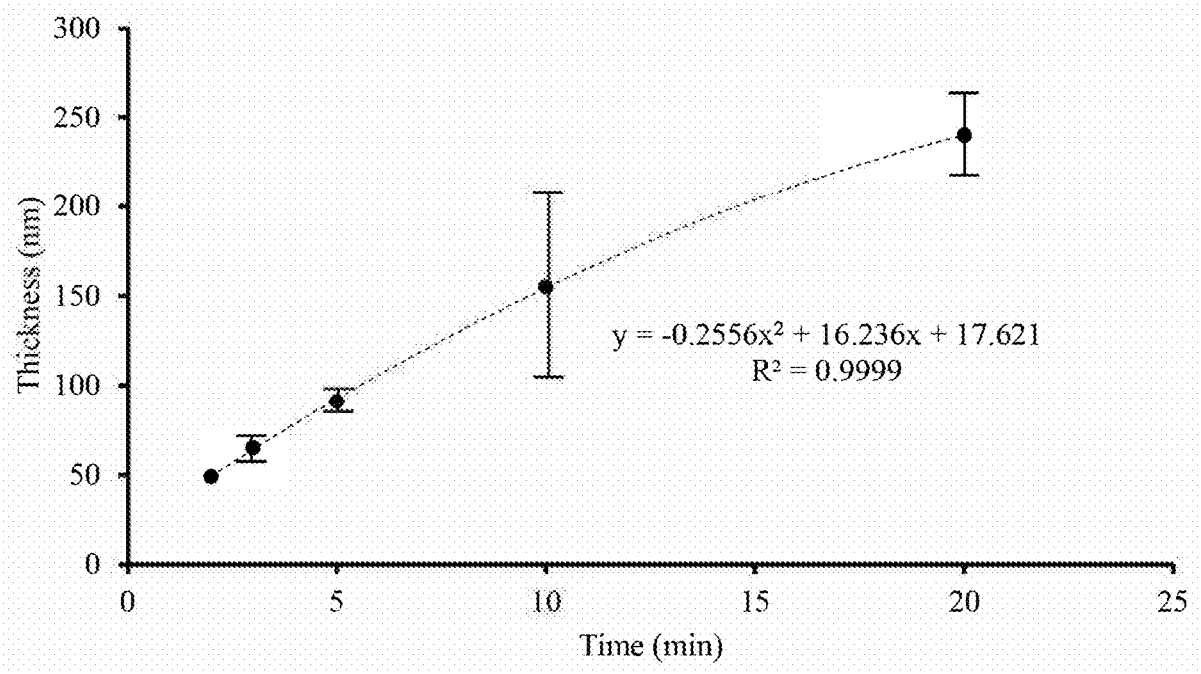
FIG. 13. is a graph showing the relationship between treatment (reaction) times and the average thickness of the resulting palladium layers on copper metal coupons.

Example 12: Evaluating the Relationship Between Treatment Time and the Resulting Amount and Quality of Palladium Plated onto Copper Coupons In order to evaluate the relationship between treatment time and the resulting amount and quality of palladium plated onto copper coupons, a plating bath comprised of 0.38% (w/w) palladium sulfate, 5.0% (w/w) PABS and 6.0% (w/w) $H_2SO_4$ was prepared. The coupons were sonicated in isopropanol for 3 minutes and immersed in a solution of 2.5% (w/w) sulfuric acid at 35° C. for 3 minutes. Coupons were submerged in deionized water for 2 minutes and allowed to air dry. After cleaning, the coupons were activated by immersing in a solution of 5.0% (w/w) PABS and 6.0% (w/w) $H_2SO_4$ for 1 minute. The coupons were then rinsed and immersed in the individual plating solutions for selected reaction times. After plating, the coupons were submerged in deionized water for 5 minutes, then submerged in isopropanol for 1 minutes, and allowed to air dry. As illustrated in FIG. 12, copper coupons had visual changes of color as a function of treatment time in the palladium-containing plating bath. Also illustrated in FIG. 13 is the effect of reaction time on the thickness of the palladium layer measured using X-ray fluorescence; the reaction times (from left to right) were 2 minutes, 3 minutes, 5 minutes, 10 minutes, and 20 minutes. Not intending to be bound by theory, the results show that the plating thickness can be controlled by the length of contact time in the plating bath.

Figure 14A:
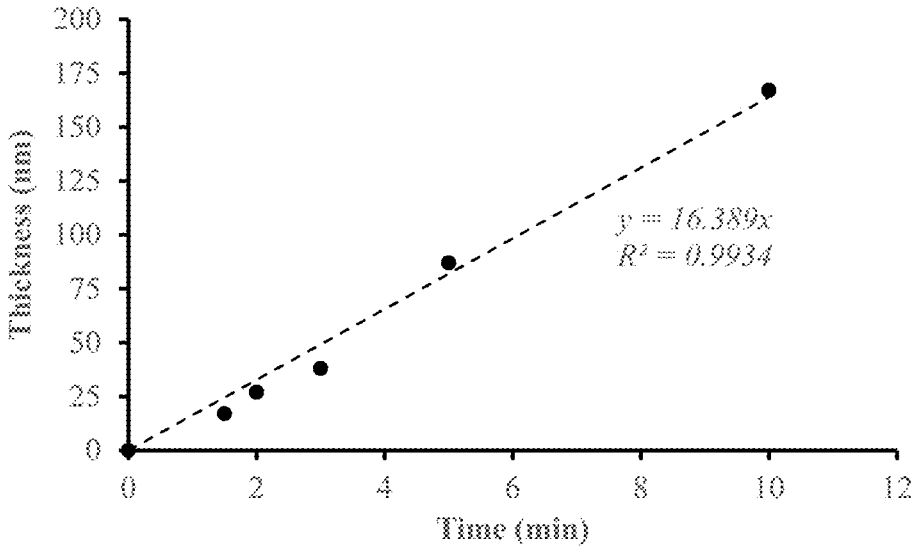
FIG. 14A shows a plot depicting the relationship between treatment times and the thicknesses of the resulting Au layers on nickel metal coupons where the Au layer thicknesses were measured using X-ray fluorescence.
Figure 14B:
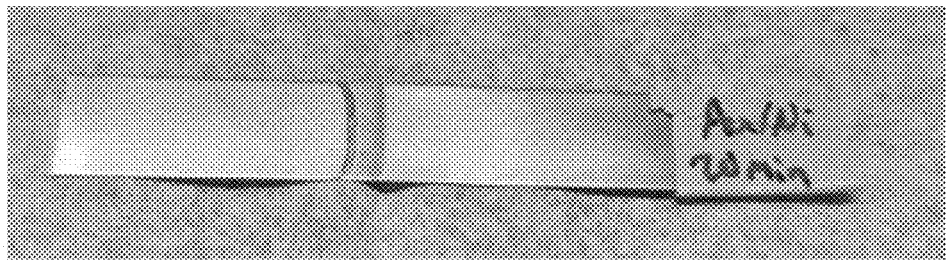
FIG. 14B is an image showing the change in nickel coupons coloration after being submerged in gold-containing plating bath for 20 minutes.

Example 13: Treatment Times and the Thicknesses of the Resulting Au Layers on Nickel Metal Coupons FIG. 14A illustrates the relationship between treatment times and the thicknesses of the resulting Au layers on nickel metal coupons. The plating bath is a solution of 0.50% (w/w) sodium tetrachloroaurate, 6.3% (w/w) sodium sulfite, 1.58% (w/w) sodium thiosulfate, 1.74% (w/w) dipotassium hydrogen phosphate, 2.0% (w/w) PABS, and 3.52% (w/w) ascorbic acid at 40° C. The nickel coupons were sonicated in isopropanol for 3 minutes and immersed in a solution of 2.5% (w/w) sulfuric acid at 35° C. for 3 minutes. Coupons were submerged in deionized water for 2 minutes and allowed to air dry. After cleaning, the coupons were activated by immersing in a solution containing 5% (w/w) oxalic acid and 5% (w/w) PABS at 70° C. for 5 minutes. The samples were then transferred to the plating solution for selected reaction times. After plating, the coupons were submerged in deionized water for 5 minutes, then submerged in isopropanol for 1 minutes, and allowed to air dry. The gold layer thicknesses were measured using X-ray fluorescence. The results show that the plating thickness is controlled by the length of contact time in the plating bath. As illustrated in FIG. 14B, nickel substrates show visual change of color after submerged in gold-containing plating bath (left side of coupon). Not intending to be bound by theory, results show that the plating thickness is controlled by the length of contact time in the plating bath.

Figure 15A:
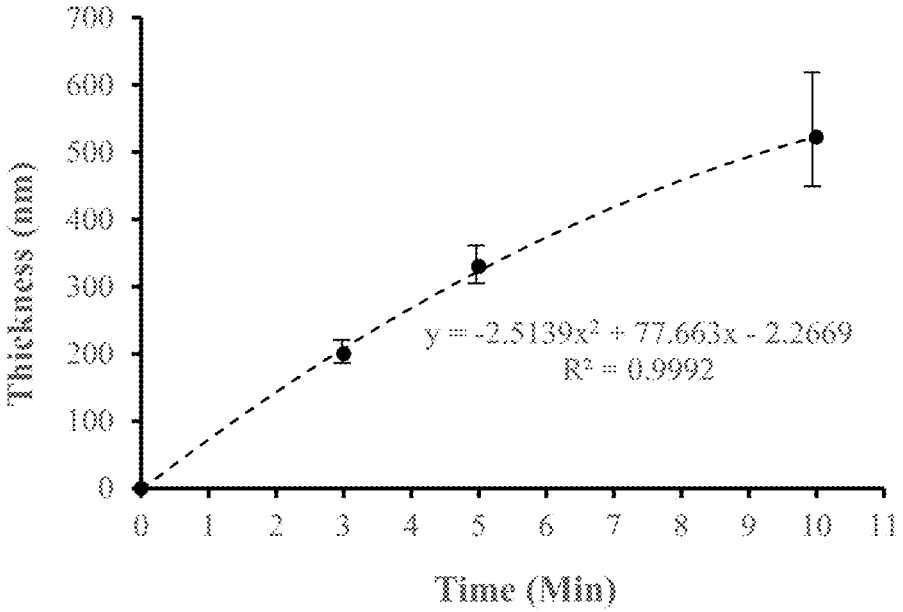
FIG. 15A illustrates the relationship between treatment times and the thicknesses of the resulting Ag layers on nickel metal coupons. The Ag layer thicknesses were measured using X-ray fluorescence after submersion in a silver-containing plating bath for 3, 5, and 10 minutes.
Figure 15B:
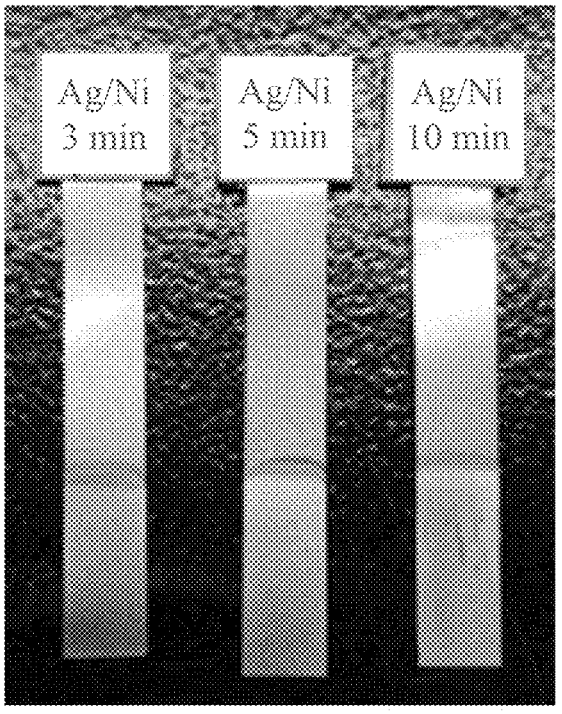
FIG. 15B illustrates examples of Ag coated onto nickel metal coupons.

Example 14: Treatment Times and the Thicknesses of the Resulting Ag Layer on Nickel Metal Coupons FIG. 15A illustrates the relationship between treatment times and the thicknesses of the resulting Ag layers on nickel metal coupons. The plating bath was a solution of 0.39% (w/w) silver nitrate, 6.3% (w/w) sodium sulfite, 1.58% (w/w) sodium thiosulfate, 1.74% (w/w) dipotassium hydrogen phosphate, 2.0% (w/w) PABS, and 3.52% (w/w) ascorbic acid at 40° C. The nickel coupons were sonicated in isopropanol for 3 minutes and immersed in a solution of 2.5% (w/w) sulfuric acid at 35° C. for 3 minutes. Coupons were submerged in deionized water for 2 minutes and allowed to air dry. After cleaning, the coupons were activated by immersing in a solution containing 5% (w/w) oxalic acid and 5% (w/w) PABS at 70° C. for 5 minutes. The samples were then transferred to the plating solution for selected reaction times. After plating, the coupons were submerged in deionized water for 5 minutes, then submerged in isopropanol for 1 minutes, and allowed to air dry. The silver layer thicknesses were measured using X-ray fluorescence. The results show that the plating thickness is controlled by the length of contact time in the plating bath. As illustrated in FIG. 15B, nickel substrates show visual change of color after submerged in silver-containing plating bath. Not intending to be bound by theory, results show that the plating thickness is controlled by the length of contact time in the plating bath.

Figure 16A:
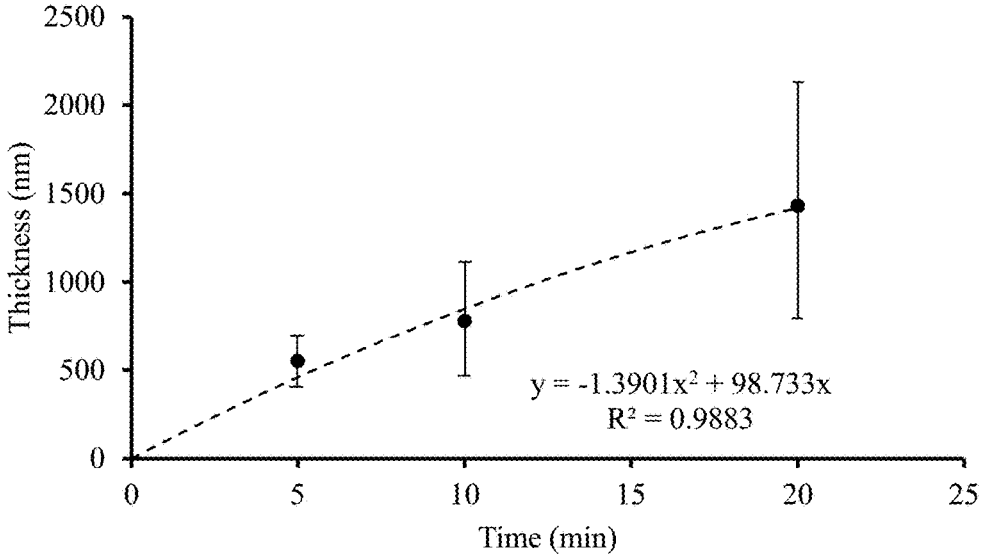
FIGS. 16A-16B illustrate the relationship between treatment times and the thicknesses of the resulting Pd layers on nickel metal coupons.
Figure 16B:
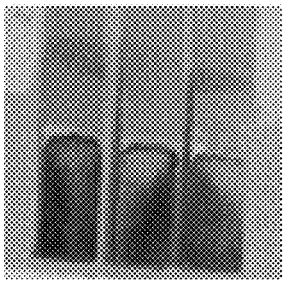

Example 15: Treatment Times and the Thicknesses of the Resulting Pd Layers on Nickel Metal Coupons FIG. 16A illustrates the relationship between treatment times and the thicknesses of the resulting Pd layers on nickel metal coupons. The plating bath was a solution of 0.525% (w/w) palladium chloride, 2.4% (w/w) PABS, and 5.0% (w/w) oxalic acid at room temperature. The nickel coupons were sonicated in isopropanol for 3 minutes and immersed in a solution of 2.5% (w/w) sulfuric acid at 35° C. for 3 minutes. Coupons were then submerged in deionized water for 2 minutes and allowed to air dry. After cleaning, the coupons were activated by immersing in a solution containing 5% (w/w) oxalic acid and 5% (w/w) PABS at 70° C. for 5 minutes. The samples were then transferred to the plating solution for selected reaction times. After plating, the coupons were submerged in deionized water for 5 minutes, then submerged in isopropanol for 1 minutes, and allowed to air dry. The palladium layer thicknesses were measured using X-ray fluorescence. The results show that the plating thickness is controlled by the length of contact time in the plating bath. As illustrated in FIG. 16B, nickel substrates show visual change of color after submerged in palladium-containing plating bath. Not intending to be bound by theory, results show that the plating thickness is controlled by the length of contact time in the plating bath.

We claim:

1. A method of applying a metal to a substrate, the method comprising contacting the substrate with an aqueous metal plating composition comprising
polyammonium bisulfate ("PABS") and
a dissolved first metal or salt thereof;

allowing the dissolved first metal or salt thereof to deposit on the substrate in a layer; and rinsing the substrate with water to form a metal-treated substrate, wherein the aqueous metal plating composition comprises from about 1% to about 50% (w/w) PABS and from about 0.001% to about 25% (w/w) dissolved first metal or salt thereof, and wherein the aqueous metal plating composition comprises a pH below about 2.

2. The method of claim 1, wherein the contacting step comprises applying the aqueous metal plating composition to a first surface area of the substrate and omitting the aqueous composition from a second surface area of the substrate, thereby forming a metal pattern on the substrate.

3. The method of claim 2, wherein the substrate is an insulating material, and wherein the metal pattern on the substrate is a continuous metal path for conducting an electrical current, and wherein the continuous metal path comprises a width in a range of about $1\times10^{-10}$ m to about $1\times10^{-2}$ m.

4. The method of claim 1, wherein the substrate is selected from the group consisting of wrought iron, cast iron, steel, carbon steel, stainless steel, aluminum, magnesium, copper, zinc, titanium, nickel, cobalt, tin, lead, silicon, and alloys thereof.

5. The method of claim 1, wherein the substrate comprises a ceramic, plastic, circuit board, or graphene.

6. The method of claim 5, wherein the substrate is a plastic, and wherein the plastic is selected from the group consisting of acrylonitrile butadiene styrene (ABS), phenolic, urea formaldehyde, polyethersulfone, polyacetal, diallyl phthalate, polyetherimide, polytetrafluoroethylene, polyarylether, polycarbonate, polyphenylene oxide, mineral reinforced nylon (MRN), polysulfone, and combinations thereof.

7. The method of claim 1, wherein the dissolved metal is selected from the group consisting of silver (Ag), gold (Au), bismuth (Bi), chromium (Cr), copper (Cu), iron (Fe), iridium (Ir), molybdenum (Mo), nickel (Ni), palladium (Pd), platinum (Pt), rhodium (Rh), ruthenium (Ru), tin (Sn), titanium (Ti), zinc (Zn), and combinations thereof.

8. The method of claim 1, wherein the aqueous metal plating composition comprises two or more metals or salts thereof, and wherein the two or more metals are selected from the group consisting of silver (Ag), gold (Au), bismuth (Bi), chromium (Cr), copper (Cu), iron (Fe), iridium (Ir), molybdenum (Mo), nickel (Ni), palladium (Pd), platinum (Pt), rhodium (Rh), ruthenium (Ru), tin (Sn), titanium (Ti), zinc (Zn), and combinations thereof.

9. The method of claim 8, wherein the aqueous metal plating composition comprises a first metal or salt thereof and a second metal or salt thereof, wherein the first metal comprises a first standard reduction potential, wherein the second metal comprises a second standard reduction potential, and wherein a difference in the first and second standard reduction potentials is in a range of from about 0 V to about 2 V.

10. The method of claim 1, further comprising contacting the metal-treated substrate with a second aqueous metal plating composition comprising a second metal or salt thereof in a concentration of about 0.001% (w/w) to about 10% (w/w).

11. The method of claim 10, wherein the second metal is selected from the group consisting of silver (Ag), gold (Au), bismuth (Bi), chromium (Cr), copper (Cu), iron (Fe), iridium (Ir), molybdenum (Mo), nickel (Ni), palladium (Pd), platinum (Pt), rhodium (Rh), ruthenium (Ru), tin (Sn), titanium (Ti), zinc (Zn), and combinations thereof.

12. The method of claim 1, wherein the aqueous metal plating composition comprises a temperature in a range from about 0° C. to about 100° C.

13. The method of claim 1, wherein the aqueous metal plating composition comprises at least two dissolved metals or salts thereof, the method further comprising before rinsing the substrate, raising a temperature of the aqueous metal plating composition to a temperature in the range of about 40° C. to about 100° C. to form an alloyed surface.

14. The method of claim 1, wherein the substrate is a metallic substrate, and wherein the method further comprises contacting the metal-treated substrate with a second aqueous metal plating composition comprising PABS and a dissolved second metal or salt thereof, wherein the second metal has a higher standard reduction potential than the first metal, and wherein the second metal replaces the first metal on the substrate.

15. The method of claim 1, wherein the substrate is a metallic substrate, and wherein contacting comprises a process selected from the group consisting of immersion, spraying, application of a foam or gel, micro-droplet deposition, nanoprinting, or application with an automated or manual brush or mechanical device.

16. The method of claim 1, wherein the substrate is a metallic substrate, wherein the layer is a first metal layer, and wherein the method further comprises contacting the metal-treated substrate with a second aqueous metal plating composition comprising PABS and a dissolved second metal or salt thereof, and allowing the dissolved second metal or salt thereof to deposit in a second metal layer on the first metal layer.

17. The method of claim 16, further comprising repeating the contacting, depositing, and rinsing sequence of steps one or more times with one or more aqueous metal plating compositions comprising PABS and a dissolved metal or salt thereof until metal layers accumulate to a desired thickness.

18. The method of claim 17, further comprising repeating the contacting, depositing, and rinsing sequence of steps one or more times with one or more aqueous metal plating compositions comprising PABS and a dissolved metal or salt thereof until the total number of metal layers is from about 2 to about 10.

19. The method of claim 1, wherein the substrate is a metallic object, and wherein contacting comprises applying the aqueous metal plating composition to an interior surface of the metallic object, wherein the metallic object is selected from the group consisting of pipes, pipe-fittings, valves, storage tanks, and other components of systems used to transport water, liquid petroleum products, or gases.

20. The method of claim 19, wherein the metallic object comprises two or more metallic parts connected in a series for transport of a liquid or gas.

21. The method of claim 20, wherein the two or more metallic parts allow transport of a gas, and wherein the gas is selected from the group consisting of hydrogen, methane, ethane, propane, butane, and combinations thereof.

22. The method of claim 20, wherein the two or more metallic parts allow transport of a liquid, and wherein the liquid is a petroleum product.

23. The method of claim 1, wherein the aqueous metal plating composition further comprises an acid or a chelating agent.

24. The method of claim 1, further comprising applying an electrical current to the metal plating composition.

25. The method of claim 1, wherein the aqueous metal plating composition further comprises at least one reducing agent comprising ascorbic acid, oxalic acid, glyoxylic acid, glycolic acid, glucose, saccharose, polyphenols, butylamine, tartrate, formaldehyde, formic acid, maleic acid, ethanolamines, hypophosphite, hydrazine, hydroxylamine, hydrogen peroxide, borohydride, aminoboranes, sulfite salts, thiosulfate salts, cobalt-containing salts, iron-containing salts, tin-containing salts, vanadium-containing salts, or titanium-containing salts.

26. The method of claim 1, wherein the aqueous metal plating composition further comprises a chelating agent and/or complexing agent comprising ethylenediamine, a tartrate salt, an alkanol amine, ethylenediamine tetraacetic acid (EDTA) or a derivative thereof, a sulfite salt, a thiosulfate salt, saccharose, oxalic acid, a citrate salt, a tartrate salt, a formate salt, or glucose.

27. The method of claim 1, wherein the aqueous metal plating composition further comprises an additive comprising thiourea, thiosulfate, citrate, 4-mercaptobenzoic acid, polyethylene glycol, sodium polyanethole sulfonate, an oxyanion, or a metal cation.

* * * * *